US008347496B2

(12) United States Patent
Garner, Jr.

(10) Patent No.: US 8,347,496 B2
(45) Date of Patent: Jan. 8, 2013

(54) TERMINAL APPLICATOR METHOD

(75) Inventor: Wesley Thomas Garner, Jr., Wake Forest, NC (US)

(73) Assignee: SureTech Assembly, Inc., Youngsville, NC (US)

( * ) Notice: Subject to any disclaimer, the term of this patent is extended or adjusted under 35 U.S.C. 154(b) by 0 days.

(21) Appl. No.: 13/267,010

(22) Filed: Oct. 6, 2011

(65) Prior Publication Data

US 2012/0023745 A1 Feb. 2, 2012

Related U.S. Application Data

(62) Division of application No. 12/489,551, filed on Jun. 23, 2009, now Pat. No. 8,061,027, which is a division of application No. 11/544,277, filed on Oct. 5, 2006, now Pat. No. 7,565,735.

(60) Provisional application No. 60/724,430, filed on Oct. 7, 2005, provisional application No. 60/758,084, filed on Jan. 12, 2006.

(51) Int. Cl.
*H01R 43/04* (2006.01)

(52) U.S. Cl. ..... 29/861; 29/566.2; 29/748; 29/33 M; 72/389.1; 72/420; 72/421; 439/442; 439/391; 439/207

(58) Field of Classification Search ..... 29/861, 29/863, 566.2, 748, 753, 862, 33 M, 513; 72/389.1, 420, 421; 439/442, 391, 421, 207, 439/585, 460, 470, 865, 869, 874, 877
See application file for complete search history.

(56) References Cited

U.S. PATENT DOCUMENTS 2,534,867 A 12/1950 Hennessey
3,553,814 A 1/1971 Rider
3,766,625 A 10/1973 Wagner
3,839,776 A 10/1974 Anderson et al.
3,867,754 A 2/1975 Koch et al.
3,911,712 A 10/1975 Wustinger et al.
4,019,362 A 4/1977 McKeever
4,043,032 A 8/1977 Spangler
4,062,106 A 12/1977 Hammond et al.
4,313,258 A 2/1982 Kindig et al.
4,667,397 A * 5/1987 Day et al. ..... 29/748
4,718,160 A 1/1988 Bulanda et al.
4,805,278 A 2/1989 Bulanda et al.
4,821,383 A 4/1989 Grosklos et al.

(Continued)

FOREIGN PATENT DOCUMENTS

EP 0817331 B1 3/2001

(Continued)

*Primary Examiner* — Derris Banks
*Assistant Examiner* — Jeffrey T Carley
(74) *Attorney, Agent, or Firm* — Ward and Smith, P.A.

(57) ABSTRACT

Methods are provided for automatically crimping terminals or connectors to wires wherein the terminals or connectors are provided in strip form and may be of varying sizes, shapes, and pitches. A method according to the present invention includes providing a plurality of terminal connectors, the connectors being secured to a terminal strip in side-by-side relationship with their axes extending laterally from the strip; moving a crimping die on a ram through a working stroke towards, and a return stroke away from, a crimping anvil to crimp an individual terminal connector located therebetween onto a wire during each working stroke of the ram; and indexing the strip between successive crimping operations thereby to locate a next leading connector on the strip between the die and anvil, wherein the strip is indexed by a drive mechanism contacting the strip through pressure-engagement.

5 Claims, 14 Drawing Sheets

U.S. PATENT DOCUMENTS 5,127,255 A 7/1992 Skotek
5,131,124 A 7/1992 Skotek
5,440,799 A 8/1995 Marshall et al.
5,481,796 A 1/1996 Quinn
5,483,739 A 1/1996 Smith et al.
5,491,887 A 2/1996 Quinn
5,517,749 A 5/1996 Zuin
5,577,318 A 11/1996 Smith et al.
5,967,395 A 10/1999 Ito
6,026,562 A 2/2000 McMillin et al.
6,327,775 B1 12/2001 Oishi et al.
6,367,148 B1 4/2002 Caveney et al.
6,530,257 B2 * 3/2003 Ooji et al. ..... 72/420
6,655,013 B2 12/2003 Wilson et al.
6,763,574 B1 7/2004 Woll

FOREIGN PATENT DOCUMENTS

JP 10-50451 A 2/1998

* cited by examiner

TERMINAL APPLICATOR METHOD

CROSS-REFERENCE TO RELATED APPLICATIONS

This application is a divisional application of U.S. patent application Ser. No. 12/489,551 filed Jun. 23, 2009, which is a divisional application of U.S. patent application Ser. No. 11/544,277 filed Oct. 5, 2006 (now U.S. Pat. No. 7,565,735), the application of which claims priority to U.S. Provisional Patent Application Ser. No. 60/724,430, filed Oct. 7, 2005 and U.S. Provisional Patent Application Ser. No. 60/758,084 filed Jan. 12, 2006; all of which are incorporated by reference in their entirety.

BACKGROUND OF THE INVENTION

1. Technical Field

The invention disclosed herein relates generally to electrical terminal applicators, and more particularly to providing terminal applicator methods for automatically crimping terminals or connectors to wires wherein the terminals or connectors are provided in strip form and may be of varying sizes, shapes, and pitches.

2. Background Art

As is known in the art, a wide range of electronic and electrical products use crimp terminals to make electrical connections from wires to other wires, printed circuit boards or other components. Generally, a crimp terminal consists of three sections that function to create a proper electrical connection. The first section is the contact area, which is designed to physically connect with a mating terminal to establish an electrical connection. For example, a "pin" terminal would slide inside of a "socket" terminal to make the connection. The second section is the wire crimp area, which is designed to capture the end of a wire. The wire in this area of the terminal must be stripped; that is, the insulation around the conductor of the wire must be removed to expose the conductor portion. Metal tabs on the terminal are folded around the stripped wire very tightly. Generally, the tabs are folded so tightly that a "cold" weld occurs between the wire strands and the terminal. This crimping action provides a physical connection of the terminal to the wire as well as an electrical connection. The electrical connection is highly resistant to moisture, temperature changes, corrosion, and other negative environmental conditions that may be present. The third section is the strain relief area, which is designed to capture the wire where the insulation begins. Generally, in this section metal tabs are loosely folded around the wire insulation. The strain relief area prevents flexure of the wire from breaking wire strands in the wire crimp area.

Generally, the process for attaching a crimp terminal to a wire involves several basic steps. First, the end of the wire must be stripped to expose the correct length of bare conducting wire. Second, the stripped wire must be positioned over the terminal to properly orient the wire with the terminal. Finally, the tabs on the wire crimp and strain relief areas of the terminal must be folded and compressed, or crimped, on to the wire in a defined manner in order to create and maintain a proper electrical connection.

To accomplish the last step described above relating to crimping the terminal onto the wire, tooling specifically designed for the terminal must be used. In some cases, hand tools are used with terminals that are packaged as loose pieces. In this case, an operator secures the terminal in the hand tool by placing the base of the terminal on an anvil. While using one hand to maintain the prepared wire end in the correct position over the terminal, the operator uses the other hand to close the handles of the tool. A set of precisely designed blades then closes against the terminal. The action of the blades against the terminal as the terminal sets in the anvil provides the correct folding of the tabs in the wire crimp and strain relief sections. The use of hand tools and loose-piece terminals is a very common and popular method to crimp terminals to wires, especially amongst homeowners and electrical contractors. However, given the labor intensity and time consuming nature of this manual process, the use of hand tools is not suitable for medium to high speed/volume production.

To support high volume production, terminal applicators have been used wherein applicator tooling is typically used in conjunction with a press. The applicator is installed in the press and generally a unique applicator is required for each terminal or family of terminals (i.e., terminals of similar size, shape, etc.). In these terminal applicators, terminals packaged in daisy-chain fashion on a carrier strip (as opposed to loose-piece) are fed from a reel into a guide integral to the applicator. The applicator contains a fixed anvil, shear block, and moveable blades, all suitable for crimping the wire crimp and strain relief portion of the terminal and cutting the terminal from its carrier strip. The press has means for holding the base of the applicator in a fixed position in the press and also has means for lowering/raising a ram in the applicator to which the blades are attached. If the press is mounted on a bench-top, an operator places a prepared wire in the proper position over the terminal and actuates a pedal. The pedal triggers the press to lower the ram and then raise it to its starting position, all in one rapid and complete motion.

In these typical press terminal applicators, movement of the ram by the press results in the following actions, all occurring within the applicator. First, given that the blades are attached to the ram, as the ram is lowered, the blades are pressed against the terminal as it rests against the fixed anvil. This action crimps the terminal to the wire. Second, the shear block is activated to cut the terminal from the terminal carrier strip. Finally, through a cam mechanism in the applicator, movement of the ram also drives a feed pawl which advances terminals into position over the anvil. Depending upon the design of the applicator and specific requirements of the terminal, terminals may be advanced on either the upward or downward motion of the ram (known as post-feed or pre-feed). Additionally, in some applicators, the terminal is advanced using a pneumatic feed mechanism mounted on the applicator.

In addition to being mounted on bench-tops as described hereinabove, terminal applicator presses can also be installed on fully automated wire processing equipment as shown in the prior art. In this configuration, the press is activated under control of the wire processing equipment as opposed to manual control. Once set-up and operational, this type of equipment cuts, strips, and terminates wires with no human involvement with production rates that can support high volume operations. In some fully automated wire processing equipment, the presses have a feature called crimp force analysis. In these presses, the force required to move the ram in the applicator is measured and analyzed to determine the quality of the crimp.

Various configurations of terminal applicators of varying types are known in the prior art as described hereinbelow.

U.S. Pat. No. 3,553,814 to Rider is directed to an applicator for crimping electrical terminals in the form of a continuous belt onto the ends of wires and substantially simultaneously removing the crimped terminations from the belt. The applicator has a crimping die and crimping anvil which are movable relatively towards and away from each other and the belt of terminals is fed along a feed path extending behind the dies to present the leading terminal on the belt to the dies. After crimping, the terminal feed means moves laterally off the feed path away from the dies while the terminal is held between the dies so that the crimped terminal is broken away from the belt. A pair of spaced-apart sprocket wheels are disclosed which engage spaced-apart perforations on the terminal belt and push/pull the belt through the crimping zone during operation.

U.S. Pat. No. 4,043,032 to Spangler is directed to a terminal applicator apparatus wherein terminals provided on a continuous belt are indexed towards crimping dies and wherein the crimped wire end is moved away from the belt and the crimping dies so that the terminal is broken away from the belt. A sprocket wheel is provided which includes teeth that engage perforations on the belt and function to index the belt through the press, thereby presenting the lead terminal of the belt at the crimping station during each operating cycle. An ejection means spaced laterally from the feed path moves into engagement with the wire and away from the crimping dies, while the other end of the wire is held by a wire clamp, so that the crimp terminal is broken away from and removed from the belt.

U.S. Pat. No. 4,667,397 to Day et al. discloses a machine for crimp connecting an electrical lead wire to a terminal wire or the like. The device includes means for cooperatively feeding a length of electrical lead, a length of terminal, and a crimp connector strip carrying a series of crimp connectors. The device further includes a die set assembly, a cutter movable with respect to the die set assembly, a crimper, means for positioning the cutter relative to the crimper, terminal wire length positioning means, and means for locking the means for positioning the cutter once the desired terminal length has been set.

U.S. Pat. Nos. 4,718,160 and 4,805,278 to Bulanda et al. are each directed to a terminal strip applicator that purports to disclose a self-adjusting mechanism that can accept a wide variety of structurally disparate continuously molded terminal strips and accurately apply each terminal to a wire without the need for readjustment and/or exchange of the working parts of the strip feed mechanism. The apparatus includes a terminal strip applicator feed track that automatically adjusts to accept terminal strips of varying widths and varying terminal contours. The apparatus further includes a terminal feeding mechanism for resiliently biasing the terminal strip for sequentially advancing a lead terminal of the terminal strip. The terminal feeding mechanism of these patent documents includes a feed link and a feed finger on the applicator itself for feeding of the terminal strip.

U.S. Pat. No. 5,131,124 to Skotek describes a strip feeding mechanism for terminal applicators for crimping terminals onto the ends of wires. The strip feeder is actuated by a rack on the applicator ram and a gear train which is between the applicator ram and the actual feeding mechanism. The strip feeding mechanism comprises a feed pawl or feed finger which is on the end of a pivotable arm and which moves the terminal strip.

U.S. Pat. No. 5,491,887 to Quinn is directed to an electrical terminal applicator with an improved split cycle system for the crimping die means of the applicator. The apparatus includes moving means mounted directly on the applicator frame adjacent the applicator ram and connected to the crimping die for moving the crimping die through a first portion of movement into engagement with an uncrimped terminal to preposition the terminal for crimping thereof. Additionally, the applicator ram thereafter can move the crimping die through a second portion of movement to effect crimping of the terminal.

U.S. Pat. No. 5,440,799 to Marshall et al. and U.S. Pat. No. 5,481,796 to Quinn are each directed to electrical terminal applicators with improved terminal tape moving means. Marshall et al. provides a terminal applicator having an applicator feeding system employing a very low-profile tooth mechanism wherein the mechanism is adjustable to vary the feed stroke thereof to accommodate terminal tapes with different pitches between the terminals. The applicator of Marshall et al. includes fixed stop teeth that engage the indexing apertures of a terminal tape to prevent the tape from moving back away from the crimping anvil on the return stroke of the shuttle member. Quinn discloses a typical feed mechanism with teeth that engage the slots on the carrier tape, but also discloses a guide plate which defines a pair of opposing clamping jaws for engaging and gripping outside surfaces of the tape for pulling the tape laterally off the path and away from the crimping die to break the terminal away from the tape.

U.S. Pat. No. 5,483,739 to Smith et al. and U.S. Pat. No. 5,517,749 to Zuin are each directed to an electrical terminal applicator with improved crimp height adjustment plate means. Smith et al. discloses an adjustment plate means which adjusts the crimp heights of the two crimping dies in an electrical terminal applicator wherein the adjustment plate means includes two adjusting plates which are continuously or gradually adjustable by employing ramped adjusting surfaces versus the finite number of positions of adjustment afforded by the calibrated plates of the prior art. Zuin describes a calibrated disk which can be retrofitted on existing applicator rams and includes a flexible adjusting plate mounted for rotation about an axis to selectively interpose projection means between the press ram and a first adjustable plate means to provide further adjustment of the shunt height of the crimping die.

U.S. Pat. No. 5,577,318 to Smith et al. describes an electrical terminal applicator with improved track adjustment means for a track which guides tapes with terminals secured thereto. An applicator ram is drivable in a first path through a working stroke towards, and a return stroke away from, a crimping anvil. A track guides the strip in a second path which intersects the first path of the ram and includes a track portion mounted for adjustable movement in a direction transverse to the second path. An adjusting screw is threaded into a transverse hole in the movable track portion for adjusting the position of the track portion in the direction transverse to the second path and a locking set screw is threaded into the transverse hole for jamming against an end of the adjusting screw to lock the adjusting screw and, thus, the track portion in any position of adjustment.

U.S. Pat. No. 6,026,562 to McMillin et al. discloses a global terminal assembly die of a modular design comprising a base unit assembly having several assemblies attached thereto. The possible removable assemblies include a slide retainer assembly, a terminal feed assembly, a terminal guide and brake assembly, an upper tool pack assembly, and a lower tool pack assembly. A mechanical feed assembly is disclosed which includes a feed finger that is attached to a trolley by a feed adjuster. The feed finger of the feeding mechanism cooperates with a guide and brake assembly to advance a terminal strip through the guide and brake assembly to a crimping area between the upper and lower tool pack assemblies.

Finally, U.S. Pat. No. 6,655,013 to Wilson et al. describes an applicator machine including a wire guide carried by the ram of the machine for guiding a wire into position for crimping a single-sided flag terminal thereto. The wire guide has a wire guiding surface that cooperates with lead-in angled surfaces of the crimping tool to guide the wire into alignment with the terminal.

Many companies which produce wire and cable assemblies are required to handle a wide variety of crimp terminals of varying sizes, shapes, etc. in order to satisfy customer demands. As a result, these companies must own or lease a large number of applicators in order to be able to produce a wide array of terminal products. The costs associated with owning or leasing these applicators is a major contributor to the overhead costs for the business.

Attempts have been made to reduce the cost to own or lease applicators. In one example, a product was offered that consisted of a base applicator body with interchangeable anvils, shear blocks, blades, guides, and other parts. It was intended that the end user of this type of applicator, such as personnel at wire and cable assembly companies, would purchase one (or a few) applicator bodies. Instead of ordering one complete applicator for each terminal type, only a set of parts (i.e., an anvil, shear block, blade, guide, and other items) would be needed for each terminal type and each set could be fitted onto the base applicator. Given the substantial reduction of complete applicators required, a substantial cost savings was expected. In practice, however, the cost savings was never fully realized.

Shortcomings of these prior art interchangeable applicators were based in part because little to no improvements were made to the terminal feed mechanism. Because the terminal feed mechanism remained an integral part of the mechanical workings of the applicator, no provisions existed to adapt a single feed mechanism to accommodate a wide variety of terminals. A large number of base applicators were therefore required to solve this problem, thereby defeating the goal of using one (or a few) base applicators and eroding any cost savings that was otherwise achievable.

Accordingly, there remains a need for terminal applicator apparatuses, systems, and methods for feeding, guiding and advancing a wide variety of terminals to enable terminal-specific parts (i.e., anvil, blade, and shear block) to be easily interchangeable.

BRIEF SUMMARY OF THE INVENTION

The present invention provides an applicator installed in a bench-top press or in a press installed in automatic wire processing equipment to attach crimp terminals to wires. The applicator performs the crimping process and can cut the terminal from the terminal carrier strip. The applicator may or may not have any means for advancing terminals to the applicator anvil. In the latter case, the applicator can instead comprise a separate and independent advancing mechanism located on and controlled by the bench-top press or wire processing equipment. Interchangeable guide plates can be mounted on the applicator to guide terminals of varying sizes into the applicator.

The applicator of the present invention provides several advantages, including:

1. Providing an applicator which consists of a base plus parts that are uniquely designed to crimp a specific terminal or family of terminals. The applicator is further designed to allow those unique parts to be easily interchangeable.

2. The reduction in costs to lease or own applicators as a result of the reduced functionality of the applicator and the opportunity to easily interchange unique parts.

3. Reduction in the distance the ram travels to permit higher production rates.

4. Improved accuracy and precision of crimp force analysis.

5. More consistent and accurate positioning of terminals.

6. Reduction in the likelihood of jams during the advancement and positioning of terminals.

7. Sensing of the positions of terminals on the terminal carrier strip prior to termination for the purpose of properly positioning the next terminal to be crimped.

According to one embodiment of the present invention, an apparatus for crimping electrical terminal connectors onto wires, the connectors being secured to a terminal strip in side-by-side relationship with their axes extending laterally from the strip, is provided wherein the apparatus comprises an applicator body and a ram movably mounted in relation to the body and drivable in a first path through a working stroke towards, and a return stroke away from, a crimping anvil. The apparatus further comprises a crimping die on the ram for cooperation with the anvil and adapted to crimp a terminal connector located therebetween onto a wire during each working stroke of the ram. The apparatus additionally comprises a drive mechanism adapted to contact the strip through pressure engagement and to feed the strip along a second path to locate a next leading connector on the strip between the anvil and the die.

A method is also provided for crimping electrical terminal connectors onto wires. The method generally comprises providing a plurality of terminal connectors, the connectors being secured to a terminal strip in side-by-side relationship with their axes extending laterally from the strip, and moving a crimping die on a ram through a working stroke towards, and a return stroke away from, a crimping anvil to crimp an individual terminal connector located therebetween onto a wire during each working stroke of the ram. The method further comprises indexing the strip between successive crimping operations thereby to locate a next leading connector on the strip between the die and anvil, wherein the strip is indexed by a drive mechanism contacting the strip through pressure-engagement.

A system for crimping electrical terminal connectors onto wires, the connectors being secured to a terminal strip in side-by-side relationship with their axes extending laterally from the strip, is also provided wherein the system comprises a crimp press and a universal crimp applicator adapted to be installed in the crimp press and comprising interchangeable guide plates adapted for guiding an electrical terminal connector into the applicator for crimping of the connector to a wire. The system further comprises a separate drive mechanism adapted to be located on and controlled by the crimp press to contact the strip through pressure engagement and to feed the strip along a path extending through the applicator, wherein advancement of the connector is independent from operation of the applicator.

It is therefore an object to provide terminal applicator apparatuses, systems, and methods for automatically crimping terminals or connectors to wires wherein the terminals or connectors are provided in strip form and may be of varying sizes, shapes, and pitches.

An object of the present invention having been stated hereinabove, and which is addressed in whole or in part by the present invention, other objects will become evident as the description proceeds when taken in connection with the accompanying drawings as best described hereinbelow.

DETAILED DESCRIPTION OF THE INVENTION

Terminal Assembly

Figure 1:
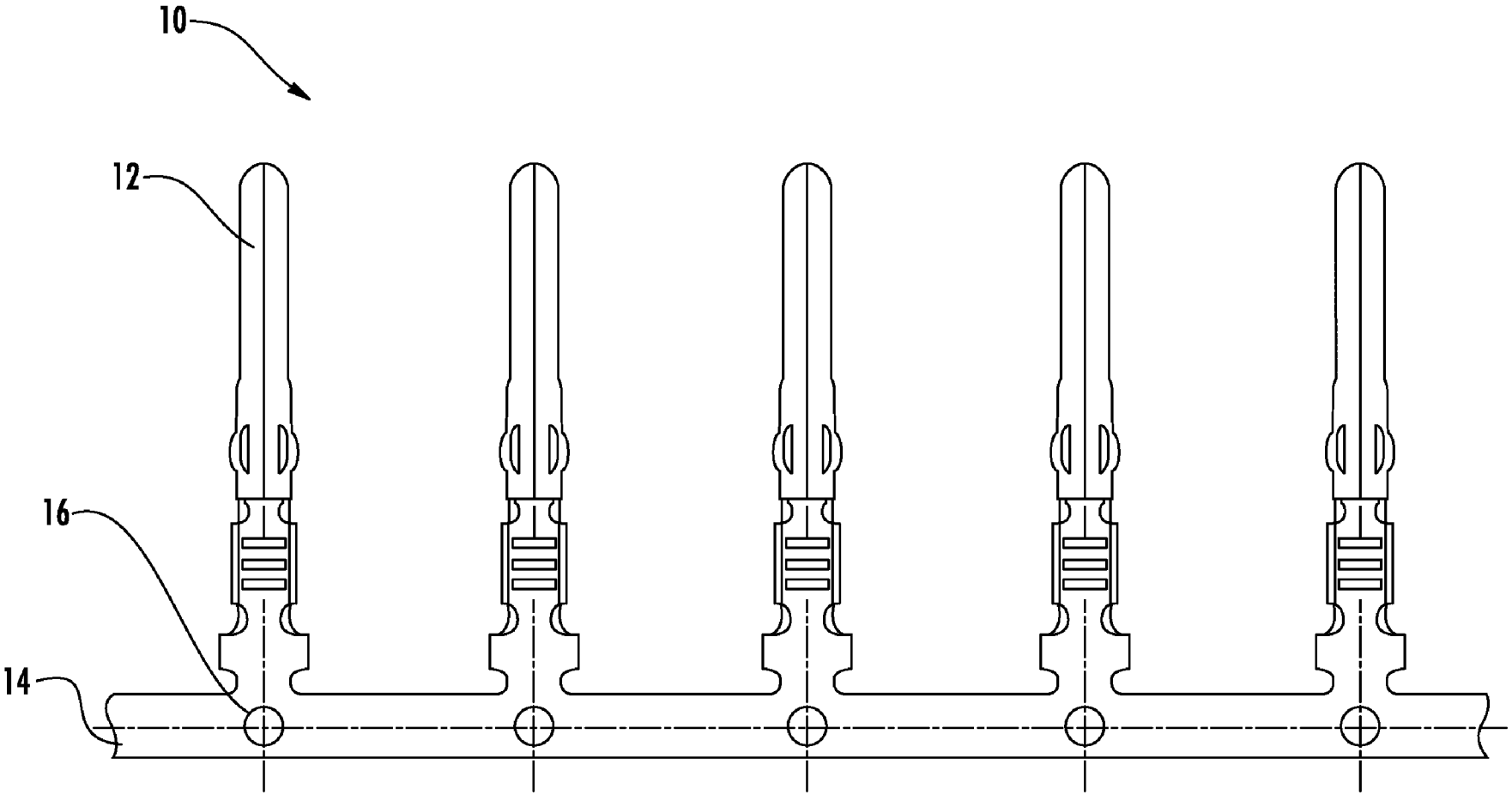
FIG. 1 is a plan view of a packaged terminal assembly such as can be used with the applicator of the present invention.

Referring now to FIG. 1, a typical packaged terminal assembly shown generally as 10, is of the type that can be used in the applicators of the present invention. Terminal assembly 10 is known in the art to support the feeding of individual terminals 12 into applicators. It is understood that terminals 12 can comprise open barrel terminals, closed barrel terminals, or any other terminal known to those of skill in the art. Many terminals 12 can be attached to a single, continuous terminal carrier strip 14 and in some cases, many thousands of terminals 12 can be produced on one terminal carrier strip 14. Terminal carrier strip 14 can comprise a plurality of feed holes 16 wherein at least one feed hole 16 is provided for each terminal 12. Each feed hole 16 can also be precisely positioned with respect to an individual terminal 12 and can be used to facilitate the manufacturing process of terminals 12. As is known in the art, feed mechanisms in applicators can also use feed hole 16 to advance and position individual terminals 12. Terminals 12 on terminal carrier strip 14 can typically be delivered in cardboard reels. Additionally, it is envisioned that other packaged terminal assemblies, including but not limited to terminals 12 attached to a tape carrier, can be used with the embodiments of the present invention as described further hereinbelow.

Applicator Operation Background

Applicators currently available from a variety of manufacturers typically include a terminal feed mechanism in the applicator. A description of the basic elements and fundamental operation of these applicators is provided below.

Figure 2:
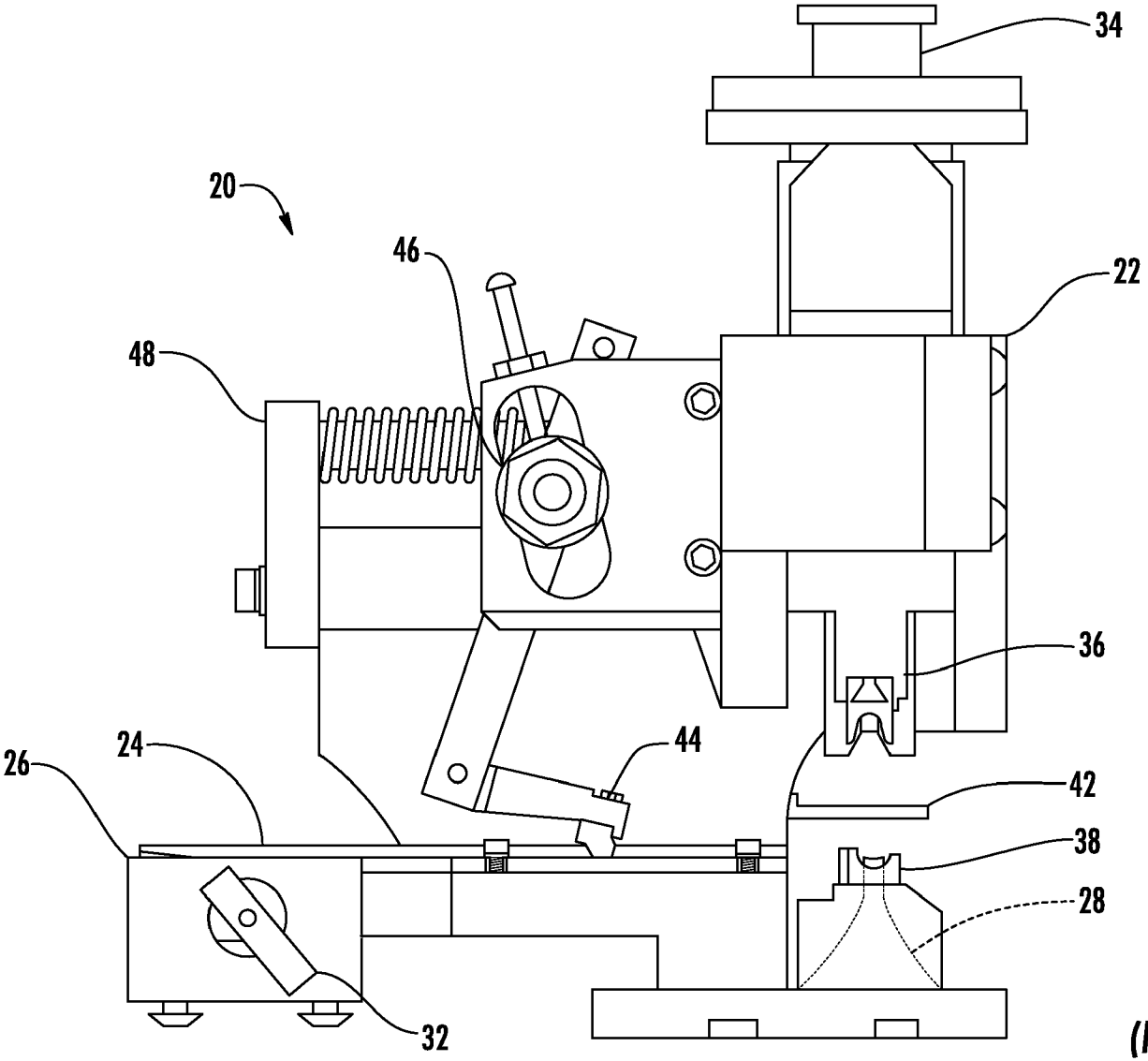
FIG. 2 (PRIOR ART)
FIG. 2 is an elevation view of an applicator of the prior art which has an integrated terminal feed mechanism.

Referring now to FIG. 2, an applicator as known in the art is shown generally as 20. Applicator 20 includes a body 22 (also referred to as a die) which provides a frame to which all other elements are attached or provides a means to capture and guide moving parts. Terminals 12 attached to a terminal carrier strip 14 in daisy chain fashion (see FIG. 1) are fed from a reel and enter terminal strip guides 24 just above a drag plate 26. During operation, terminals 12 are moved along terminal strip guides 24 toward an anvil 28. A drag plate release 32 is moved to a position to release the drag of drag plate 26 when terminals 12 are loaded by an operator into applicator 20. Once terminals 12 are loaded, drag plate release 32 is moved to a position to engage the drag. The drag must be engaged during operation of applicator 20.

Figure 3:
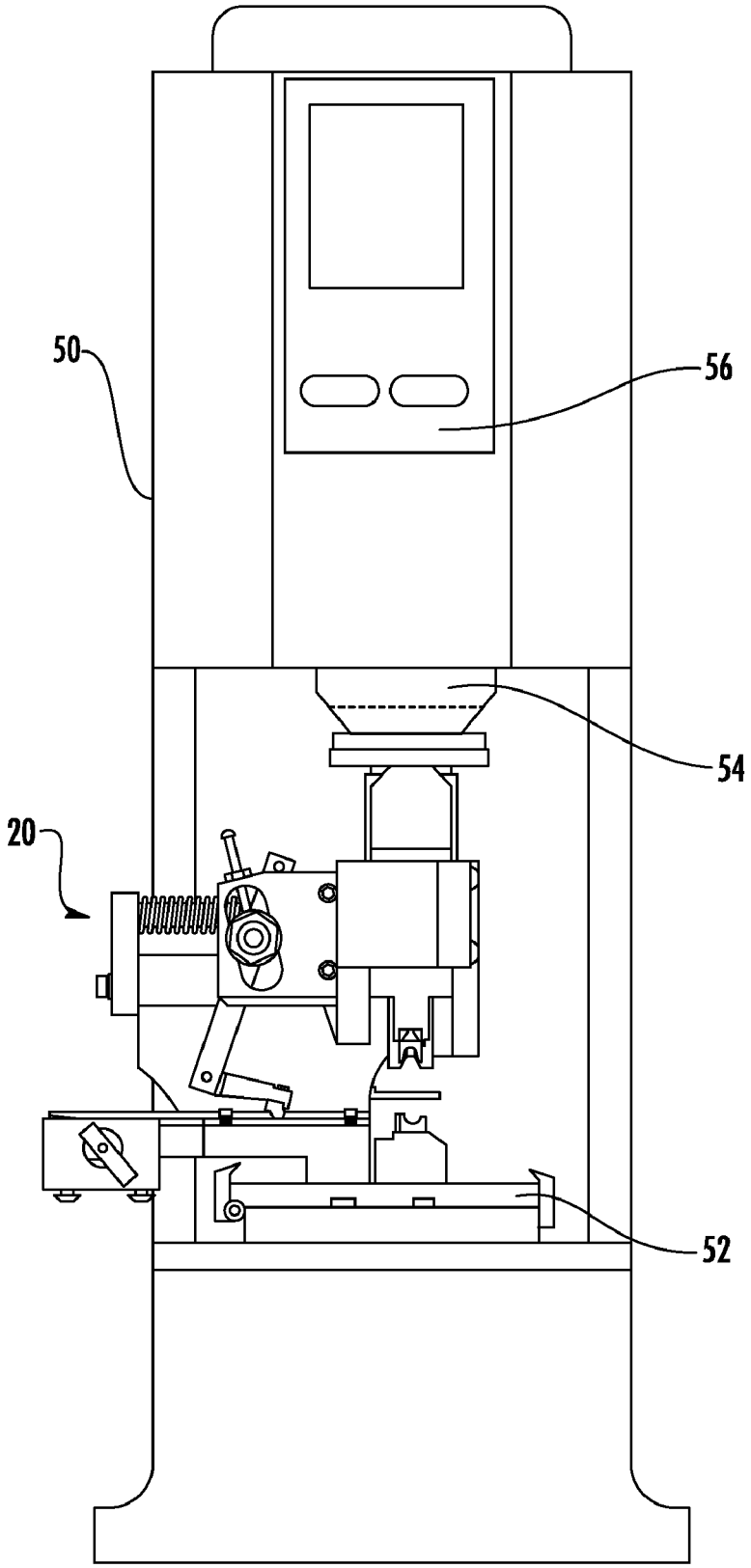
FIG. 3 (PRIOR ART)
FIG. 3 is an elevation view of an applicator of the prior art which has an integrated terminal feed mechanism installed in a press.

When applicator 20 is loaded into a press, shown generally as 50 in FIG. 3, body 22 is held in a fixed position in press 50. The top-most portion of a ram 34 slides into a fitting located in press 50 to enable the press to raise and lower ram 34 within body 22 of applicator 20. Blades 36 (also referred to as crimping die or conductor punch and insulation punch) are attached to ram 34. When ram 34 is lowered by press 50, blades 36 move toward and come in close proximity to anvil 28. If terminal 12 has been positioned properly over anvil 28 and a properly stripped wire (not shown) has been positioned properly over terminal 12, blades 36 will squeeze terminal 12 and stripped wire against anvil 28, resulting in the crimping of terminal 12 to the wire. A shear block 38 is depressed by blades 36 to cut terminal 12 from terminal carrier strip 14.

After crimping is complete and terminal 12 has been sheared from terminal carrier strip 14, ram 34 is raised to its original starting position. As ram 34 is raised, terminal 12 may not release from blades 36. If this occurs, a terminal stripper 42 removes terminal 12 from blades 36 as ram 34 rises. An operator (or wire processing equipment in automated machines) then removes the wire, with terminal 12 crimped on one end, from applicator 20.

The operation of typical feeding mechanisms will now be described. A cam mechanism (not shown) in body 22 of applicator 20 actuates a feed pawl 44 as ram 34 is raised and lowered. In many designs, the tip of feed pawl 44 fits into feed hole 16 in terminal carrier strip 14. Feed pawl 44 is angled such that it engages (pushes) on feed hole 16 when moving forward (toward anvil 28), but slides over feed hole 16 when moving backward (away from anvil 28). Drag plate 26 must be in a position to induce drag to prevent feed pawl 44 from inadvertently moving terminal carrier strip 14 as feed pawl 44 moves backward. In some designs, feed pawl 44 will push directly on one terminal 12 instead of engaging in a feed hole 16 in terminal carrier strip 14. The movement of feed pawl 44 can be adjusted by setting the position of a feed pivot 46 and adjusting a feed adjustment 48. The position of feed pivot 46 controls the throw of feed pawl 44, that is, it controls the distance feed pawl 44 travels. Feed adjustment 48 controls the position of feed pawl 44 when feed pawl 44 reaches its maximum forward position. It is understood that feed adjustment 48 and feed pivot 46 are highly interactive, thereby making feed adjustments in these prior art system very difficult.

Referring now to FIG. 3, press 50 as known in the art is shown with applicator 20 installed. Applicator 20 is typically mounted on and secured to a base 52. When applicator 20 is installed into press 50, ram 34 on applicator 20 slides into a ram fitting 54 on press 50. Ram fitting 54 is driven by a motor (not shown) in press 50 to raise and lower ram 34. A user control interface 56 can be provided to enable a user to set-up press 50 and to monitor operation.

Press 50 can be used on a bench top. In this case, a human operator presents a properly prepared wire over terminal 12 to be crimped and actuates press 50, usually via a foot pedal. Press 50 can also be installed in fully automated wire processing equipment as described below with reference to FIG. 4.

Figure 4:
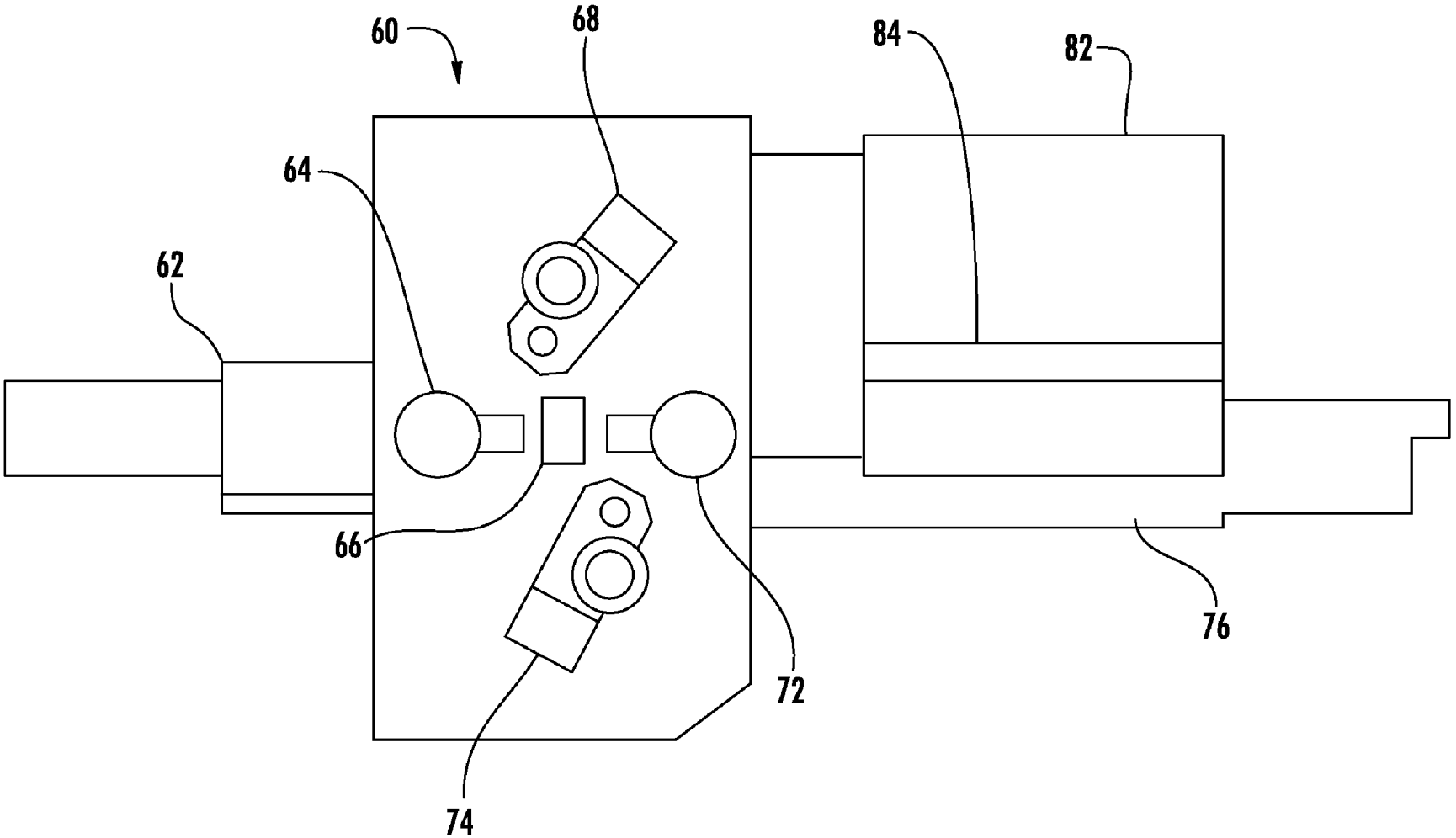
FIG. 4 (PRIOR ART)
FIG. 4 is a plan view of an automatic wire processor of the prior art.
Figure 5:
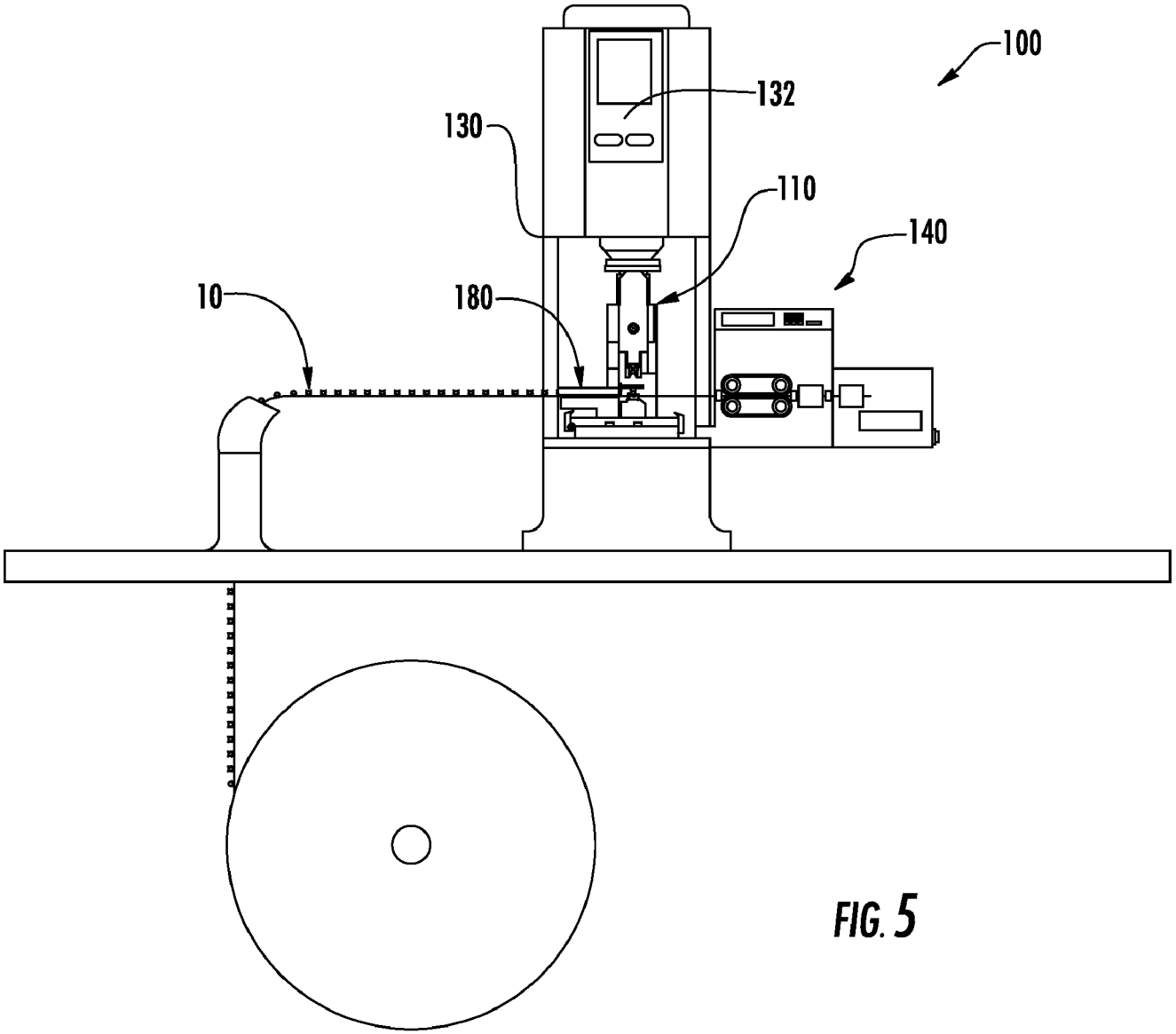
FIG. 5 is an elevation view of a terminal application assembly in accordance with one embodiment of the present invention.

FIG. 4 illustrates a plan view of an automatic wire processor 60. Wire from a drum or reel (not shown) is fed into a wire feed 62. Wire feed 62 dispenses precisely measured lengths of wire to a side 1 transfer 64 and to blades 66, which effectuate cutting of the wire. Blades 66 also strip (remove insulation) from neither, one, or both ends of the wire. Side 1 transfer 64 grabs one wire end and presents to a side 1 press 68. A side 2 transfer 72 grabs one wire end and presents it to a side 2 press 74. Applicators 20 are installed in each press if a terminal 12 must be crimped to that wire end. Completed wire leads are deposited in a wire deposit 76.

An electrical cabinet 82 can contain wiring, relays, computers, etc. (none shown) required to make automatic wire processor 60 functional. This functionality includes coordinating all elements of the machine to feed, measure, cut and strip wire; control transfers and presses; and deposit completed assemblies. A human operator can use a control panel 84 to set up, store and retrieve jobs and monitor production throughout the operation.

Embodiment with Separate Terminal Feed Mechanism

Referring now to FIGS. 5-8, one embodiment of the present invention includes a terminal application system or assembly shown generally as 100. Terminal application assembly 100 can include an applicator 110 loaded in a press 130 (similar to press 50 described hereinabove). A terminal feed mechanism 140 can be provided to pull packaged terminal assemblies 10 (see FIG. 1) through a terminal guide 180.

Figure 6:
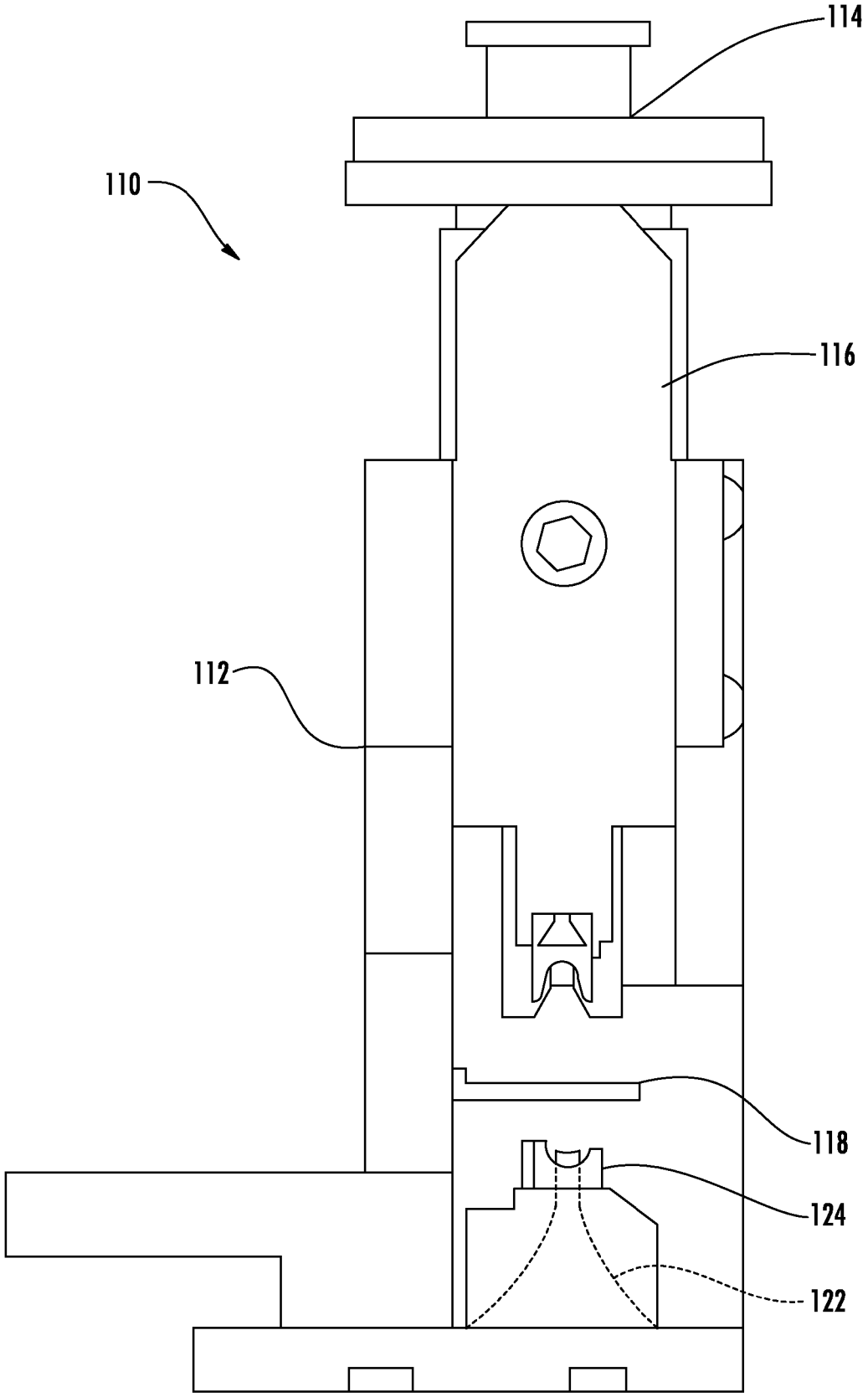
FIG. 6 is an elevation view of an applicator used in the terminal application assembly shown in FIG. 5 in accordance with one embodiment of the present invention.

Referring now to FIG. 6, applicator 110 includes a body 112 (also referred to as a die) which provides a frame to which all other elements are attached or provides a means to capture and guide moving parts. A ram 114, blades 116, terminal stripper 118, and anvil 122 perform the same functions as described hereinabove for applicator 20. A shear block 124 cuts terminal 12 from terminal carrier strip 14, but otherwise leaves terminal carrier strip 14 intact. Applicator 110, in this embodiment, does not include any mechanisms for advancing, guiding or positioning terminals 12.

Figure 7:
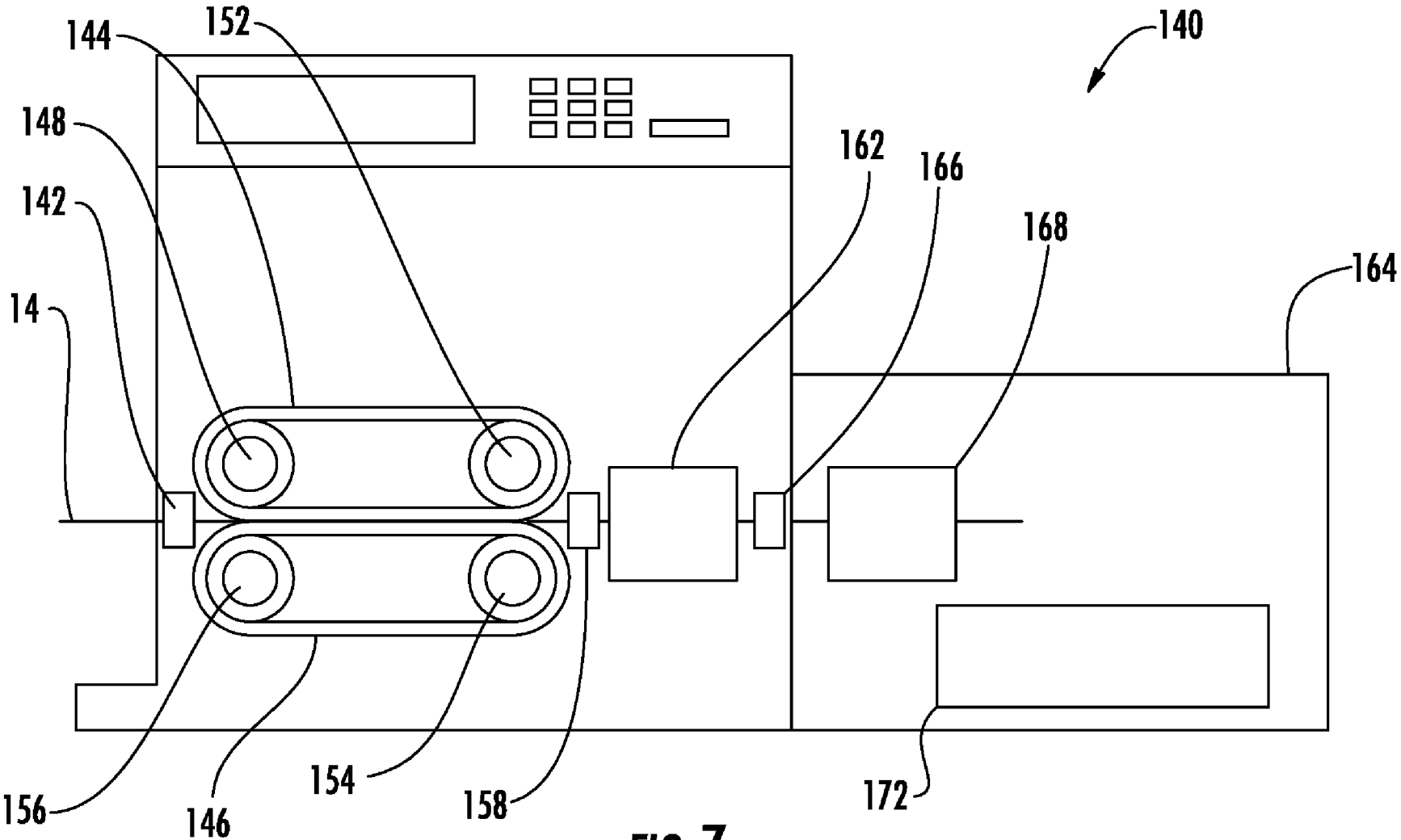
FIG. 7 is an elevation view of a terminal feed mechanism used in the terminal application assembly shown in FIG. 5 in accordance with one embodiment of the present invention.

Referring now to FIG. 7, terminal application assembly 100 can further include terminal feed mechanism 140 which can be located apart from applicator 110 (described further hereinabove) and terminal guide 180 (described further hereinbelow). Terminal carrier strip 14 (minus terminals 12) that is produced by applicator 110 after the crimping process is completed is channeled through a first guide 142. Terminal carrier strip 14 is then fed between a first belt 144 and a second belt 146. Motor roller 148, first roller 152, second roller 154, and third roller 156 are configured to enable motor roller 148 to move first belt 144 and second belt 146 and thereby move terminal carrier strip 14 in a direction from first guide 142 to a second guide 158.

Terminal carrier strip 14 can be routed through second guide 158 to a sensor 162. Sensor 162 detects the presence of feed holes 16 in terminal carrier strip 14 using optical, mechanical or other sensing means. A signal is generated by sensor 162 when it detects a feed hole 16. A controller 164 provides a signal to motor roller 148 to turn when a terminal 12 must be advanced. A trigger signal from a foot pedal (not shown) or from another controller in an automatic wire processing machine (not shown) indicates when the next terminal 12 must be advanced. Controller 164 turns motor roller 148, thereby advancing terminal carrier strip 14 (and all terminals 12 attached thereto). Motor roller 148 is turned by controller 164 until the signal from sensor 162 indicates detection of a feed hole 16.

In a separate feature of the current embodiment, terminal carrier strip 14 can also be fed through a third guide 166 and a chopper 168. Chopper 168 cuts terminal carrier strip 14 into individual pieces. The cut pieces can then be ejected into a debris tray 172 for ultimate disposal.

Figure 8:
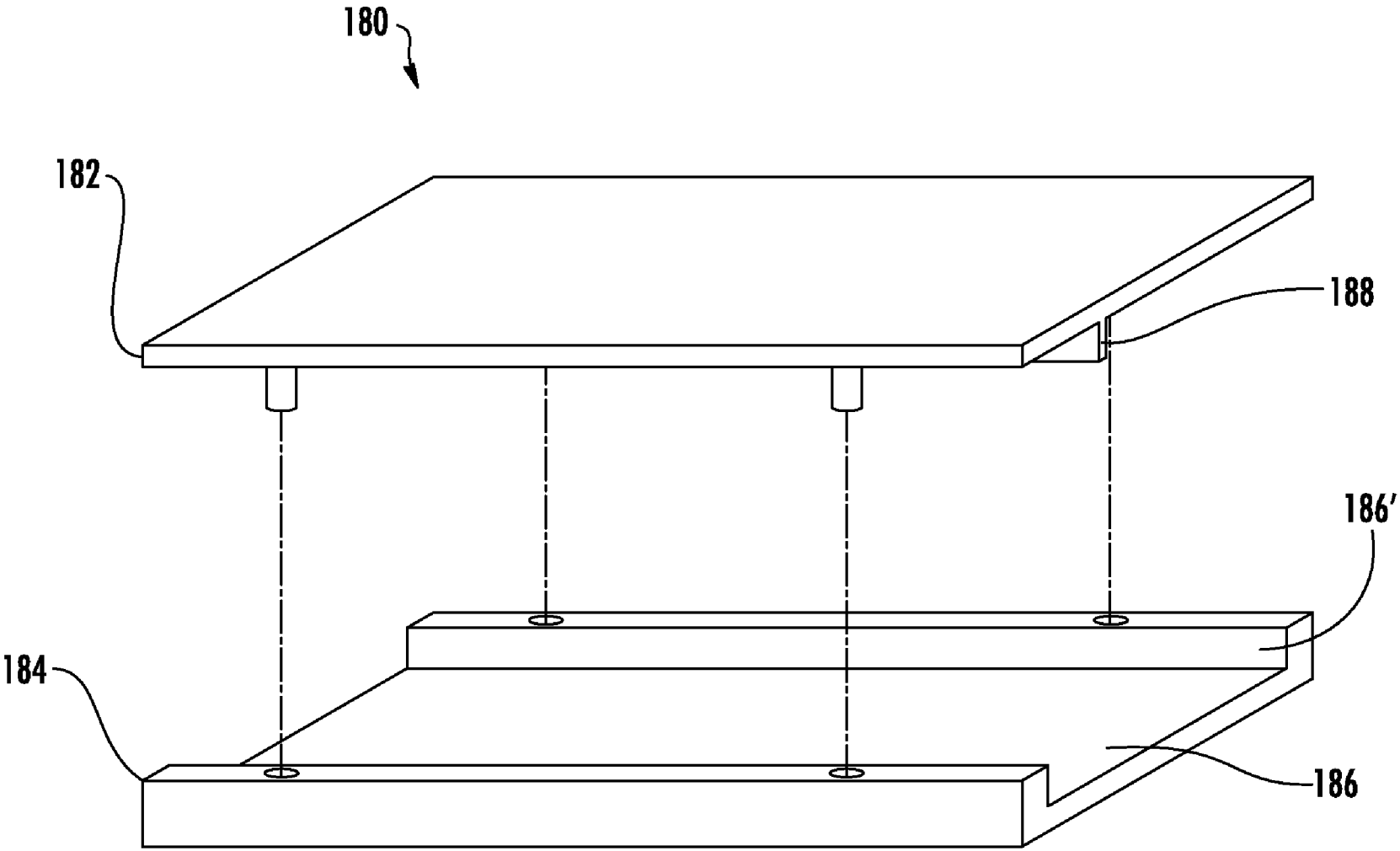
FIG. 8 is a perspective view of a terminal guide used in the terminal application assembly shown in FIG. 5 in accordance with one embodiment of the present invention.

Referring now to FIG. 8, a terminal guide 180 consists of an upper plate 182 and lower plate 184. Terminal guide 180 can be mounted on applicator 110. Lower plate 184 contains a channel 186 which is dimensioned to accommodate terminals 12. At least one outer edge of terminal carrier strip 14 rides against at least one edge 186' of channel 186. Upper Plate 182 contains a ridge 188. Ridge 188, by acting on a feature in terminal 12, presses terminal carrier strip 14 against one edge 186' of channel 186 in lower plate 184, thereby guiding terminals 12 appropriately. Terminal guide 180 typically does not include drag plate 26 (as described hereinabove) or any mechanism to intentionally induce drag.

Referring back to FIG. 5, terminal application assembly 100 can include press 130 incorporating applicator 110, terminal feed mechanism 140, and terminal guide 180 for the advancement and processing of packaged terminal assembly 10. Preferably, terminal feed mechanism 140 pulls packaged terminal assembly 10 through terminal guide 180 to applicator 110. By adjusting the position of sensor 162 in terminal feed mechanism 140, an operator can precisely position terminals 12 over anvil 122 in applicator 110. Because sensor 162 generates a signal from a feed hole 16 for each terminal 12, and this signal is used to control motor roller 148, positioning errors do not accumulate. An operator uses a foot pedal (not shown) to initiate actions by press 130 to crimp a terminal 12 to a wire (this process can also be initiated by another controller in an automatic wire processing machine (not shown)). Under control of press 130, the terminal feed mechanism 140 is triggered to operate at the proper times to advance terminals 12 for processing.

As described above with reference to FIG. 5, the position of sensor 162 in terminal feed mechanism 140 is adjusted to precisely position terminal 12 over anvil 122 in applicator 110. If the sensor 162 position were controlled by a stepper motor, for example, and the stepper motor were controlled by press 130, then terminal 12 positioning for each job could be saved in the memory of press 130. As such, positioning for each terminal 12 could be set using a user interface 132 of press 130 and, once set, would not have to be set again. Alternatively, if a sensor capable of detecting a range of feed hole 16 positions was implemented (such as by using a linear arrangement of closely spaced optical sensors), advantages described above could be accomplished with no movement or physical re-positioning of sensor 162. In yet another alternative, a single sensor (optical or otherwise) in a fixed position can be used as follows. A signal is generated after a precisely controlled time delay after a feed hole 16 is detected. The operator can control terminal 12 positions by setting the time delay.

It is understood in this embodiment that press 130 has an option to reduce the stroke of ram 114, that is, reduce the height to which ram 114 rises at the end of its cycle. The reduced height is possible since applicator 110 does not have to advance terminals 12. The reduced height allows faster production rates.

It is additionally understood in this embodiment that an operator can accommodate different terminals 12 by changing upper plate 182 of terminal guide 180 and the anvil 122, blades 116, and shear block 124 in applicator 110. This aspect will permit easy and fast interchange of parts for specific terminal crimp job requirements.

It is known in the art that some presses provide a capability called Crimp Force Analysis ("CFA"). CFA measures and analyzes the force imposed on the ram by the press motor to derive information about the quality of the crimp. For presses which perform CFA, the current embodiment presents opportunities to make the analysis simpler, more accurate and more precise. This is possible because applicator 110 is not used to advance terminals 12 and the CFA is therefore not required to determine what portion of the forces imposed on ram 114 must be allocated for terminal 12 advancement.

The embodiment described hereinabove is described for implementation on a press 130. It is understood that this embodiment can also be employed on an automatic wire processor 60, such as that described hereinabove with reference to FIG. 4. In such applications, the automatic wire processor 60 can control terminal feed mechanism 140 and sensor 162 positioning, and store those settings with other data for a specific job. This allows for fast and easy set-up the next time that job is used.

Implementation of this embodiment or variations of it do not preclude the use of standard applicators with integrated terminal feed mechanisms in bench-top presses or in presses mounted in automatic wire processing equipment. Additionally, it is understood that various modifications of this embodiment are encompassed herein, including: (1) usage of a terminal feed mechanism which pushes terminals to the applicator as opposed to pulling them through the applicator; (2) usage of a terminal feed mechanism which uses a paw engaged in the terminal carrier strip feed holes to advance terminals; (3) usage of a terminal feed mechanism which uses a paw to press directly against terminals to advance terminals; (4) usage of a pneumatic-based terminal feed mechanism; (5) usage of rollers instead of belts in a terminal feed mechanism; (6) usage of a terminal guide that is separate from the applicator; and (7) usage of a terminal guide which has adjustable features to accommodate a variety of terminals.

Embodiment with Integral Terminal Feed Mechanism

With reference to FIGS. 9-13, another embodiment of the present invention contemplates a terminal applicator including an integrated terminal feed mechanism, preferably a feed mechanism adapted to feed a variety of terminal carrier strips through pressure engagement with the strip.

Figure 9:
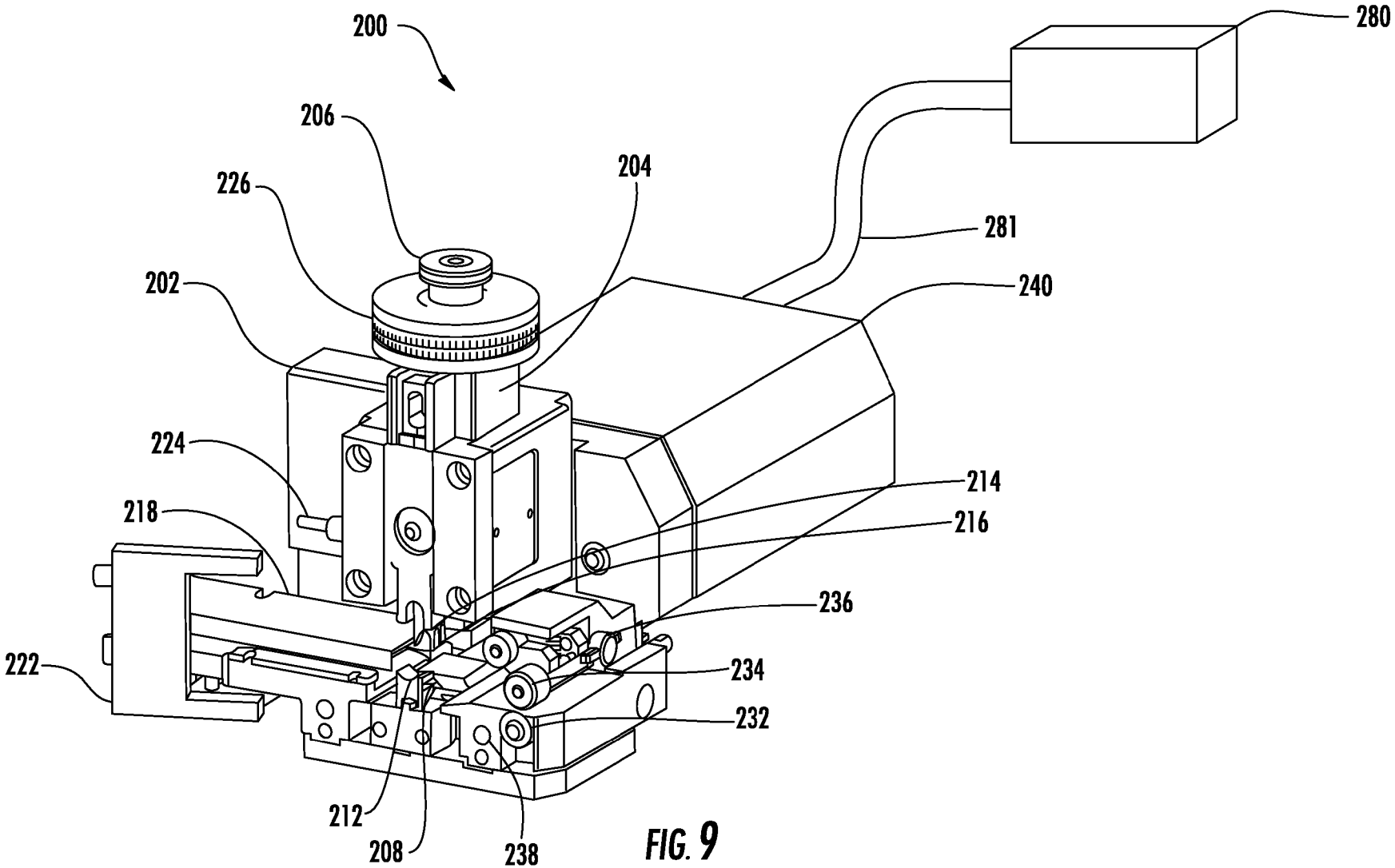
FIG. 9 is a perspective view of an applicator in accordance with one embodiment of the present invention.

Referring now to FIG. 9, an applicator is shown generally as 200 and employs a die 202 as a base or frame upon which other elements can be attached. A ram 204 within applicator 200 can be mated with a press (not shown, but similar to those described hereinabove) using a ram coupling 206. An external press moves ram 204 through a working stroke towards, and a return stroke away from, an anvil 208 and a cutter 212. Cutter 212 is activated by the downward stroke of ram 204. Cutter 212 cuts terminal 12 from terminal carrier strip 14 and otherwise leaves terminal carrier strip 14 intact. Attached to ram 204 can be an insulation punch 214 and conductor punch 216.

Terminal 12 attached to terminal carrier strip 14 is fed through and guided by a guide plate 218 to insure proper front-to-back positioning of terminal 12 over anvil 208. When a terminal 12 is properly positioned over anvil 208 and a properly stripped wire (not shown) is properly positioned over terminal 12, the complete working stroke of ram 204 first towards and then away from anvil 208 will crimp terminal 12 to the wire and cut terminal 12 from terminal carrier strip 14. The crimping of the exposed conductor of the wire to terminal 12 occurs as a result of forming elements of terminal 12 around the wire conductor as both are pressed between anvil 208 and conductor punch 216. The crimping of an insulated portion of the wire to terminal 12 (for strain relief purposes, as described hereinabove) occurs as a result of forming elements of terminal 12 around an insulated portion of wire as both are pressed between anvil 208 and insulation punch 214.

A terminal sensor 222, such as a through-beam optical sensor, can be provided and is used to sense the presence of a terminal 12 or some attribute of terminal carrier strip 14, such as a hole. Terminal sensor 222 can include a light emitter and a light receiver. Terminal 12 or terminal carrier strip 14 is positioned between the light emitter and light receiver of terminal sensor 222. An output of a first logic state occurs when the light beam from the emitter reaches the receiver unimpeded, which is the case when a terminal 12 or terminal carrier strip 14 is not in a position to block the light beam. An output of a second logic state occurs when a terminal 12 or terminal carrier strip 14 is in a position to block the light beam. The output state of terminal sensor 222 toggles as terminals 12 and terminal carrier strip 14 are moved past terminal sensor 222 because the light beam is alternately blocked/unblocked.

A ram sensor 224, such as a magnetic sensor, can be provided and is used to sense the position of ram 204. An output of a first logic state occurs when ram 204 is down. An output of a second logic state occurs when ram 204 is up. Another feature that can be located in the vicinity of ram 204 is a crimp height adjustment dial 226 that is used to set the proper crimp height.

Terminal progression, that is, the advancement and proper positioning of terminal 12 to anvil 208, preferably occurs post-termination or post-separation. In one such arrangement, an intact terminal carrier strip 14 (with terminals 12 removed after application) is pressed between a drive wheel (or roller) 232 and an idler wheel (or roller) 234. It is understood that idler wheel 234 could also be an additional drive wheel. The support structure for idler wheel 234 (not shown) can include a spring to bias idler wheel 234 toward drive wheel 232. The resulting pressure force contact on carrier strip 14 when it resides between drive wheel 232 and idler wheel 234 causes carrier strip 14 and terminals 12 attached to it (such as before application) to move as drive wheel 232 is rotated. An idler wheel release 236 can be rotated to raise idler wheel 234 away from drive wheel 232 to facilitate loading of terminal carrier strip 14 between drive wheel 232 and idler wheel 234. A drive apparatus within a motor and electronics enclosure 240 (described hereinbelow with reference to drive mechanism 250) rotates drive wheel 232 in a controlled and appropriate manner to advance and properly position terminal 12 over anvil 208. A user interface 280 is connected to motor and electronics enclosure 240 with a user interface cable 281 and is described in further detail hereinbelow with reference to FIG. 12.

Drive wheel 232 and idler wheel 234 can be attached to motor and electronics enclosure 240, all of which can be supported on an adjustable carriage (not shown). A feed carriage adjustment screw 238 typically provides front-to-back positioning control of drive wheel 232, idler wheel 234, and motor and electronics enclosure 240 on this carriage. Feed carriage adjustment screw 238 can be used by an operator during a set-up procedure to position drive wheel 232 and idler wheel 234 for proper engagement with terminal carrier strip 14. When drive wheel 232 and idler wheel 234 are properly positioned, two conditions are satisfied. First, proper engagement of drive wheel 232 and idler wheel 234 is achieved to provide proper terminal progression through pressure contact. Second, clearances behind drive wheel 232 and idler wheel 234 are available for terminal 12 to pass without creating jams in the event terminal 12 was not removed from terminal carrier strip 14 after the crimp application process.

Figure 10:
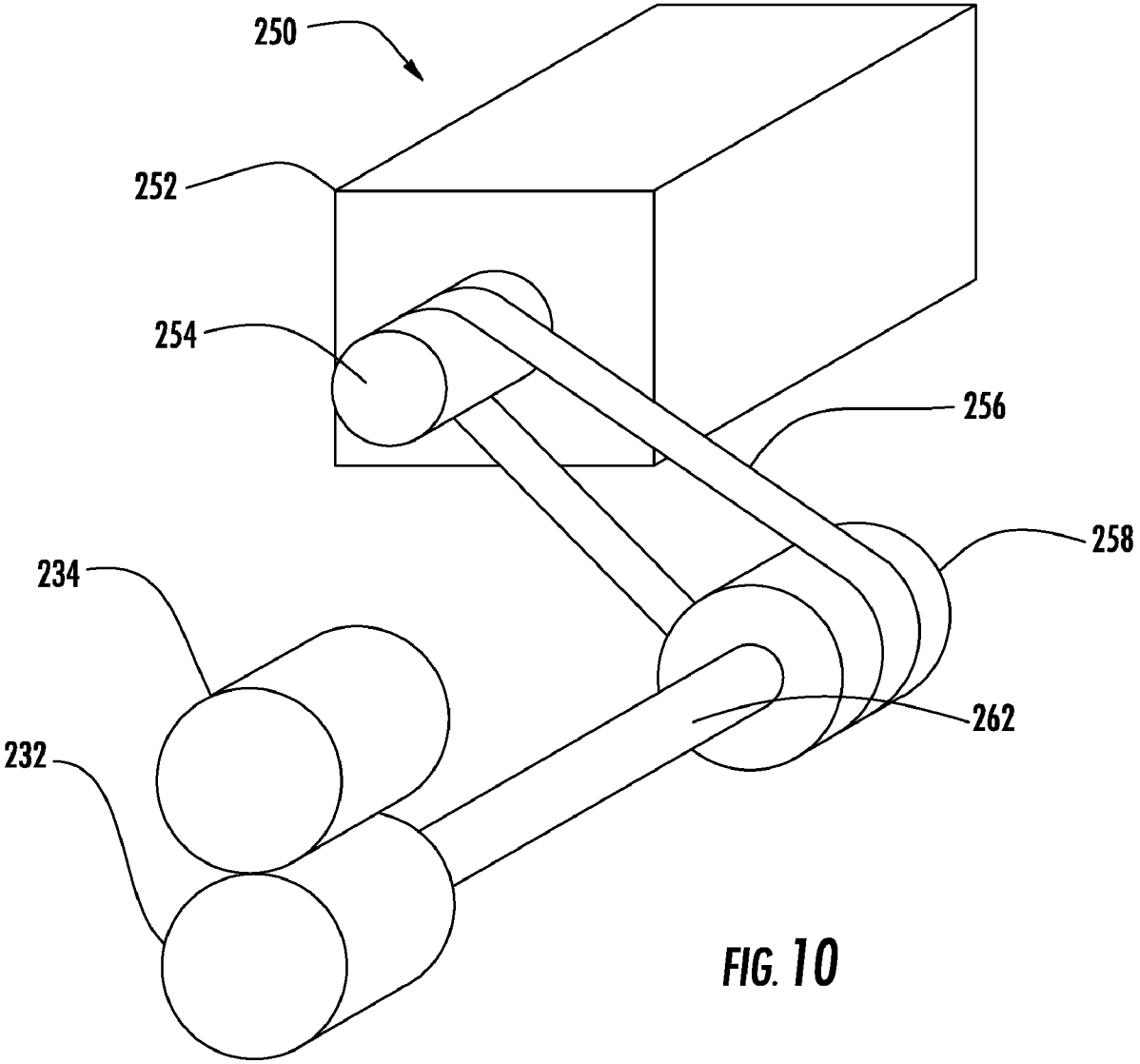
FIG. 10 is a perspective view of a drive mechanism of the applicator shown in FIG. 9 in accordance with one embodiment of the present invention.

Referring now to FIG. 10, a drive mechanism 250 can contain several elements for driving drive wheel 232, most of which preferably reside inside motor and electronics enclosure 240 (the exceptions typically being drive wheel 232 and idler wheel 234). A motor 252 is provided and is preferably a stepper motor which rotates in small, discrete steps. The amount of motor 252 rotation is controlled by the number of pulses applied to an input to motor 252. Each pulse delivered produces one increment of rotation. An example of motor 252 is motor model number 23MD106S-00-00-00 manufactured by ANAHEIM AUTOMATION™, wherein the smallest increment of rotation for this particular motor is 0.225 degrees for each pulse delivered. The rate at which pulses are delivered control motor 252 speed, with higher pulse rates producing higher motor 252 speeds. It is understood that motor 252 can additionally comprise any motor that can be used for controlling positions, such as servo motors, etc. Motor 252 is coupled to a drive shaft 262 using a motor pulley 254, belt 256, and drive shaft pulley 258. Drive wheel 232 is attached to drive shaft 262 and thereby is driven by motor 252.

Figure 11:
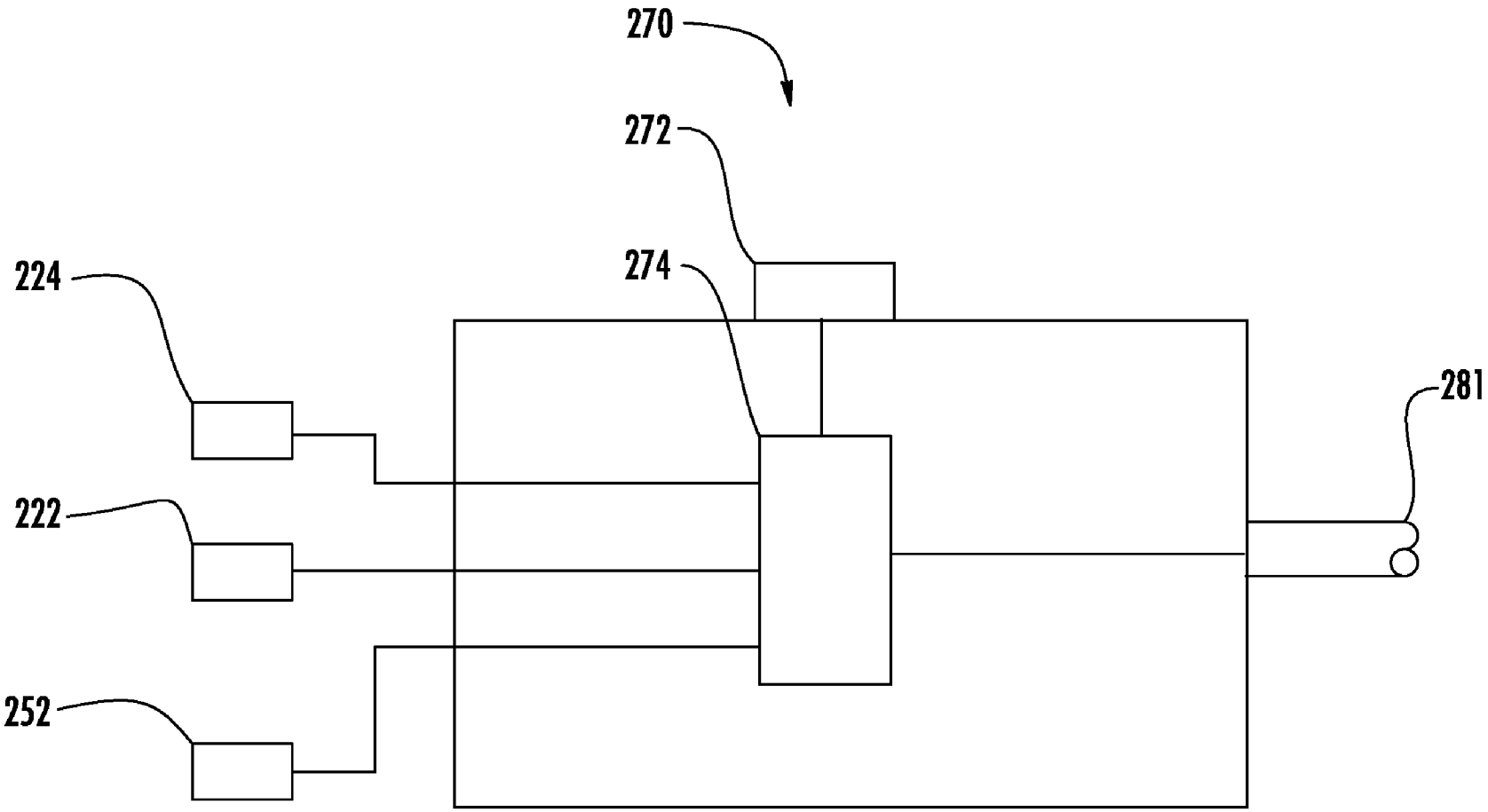
FIG. 11 is a block diagram illustrating a controller of the applicator shown in FIG. 9 in accordance with one embodiment of the present invention.

Referring now to FIG. 11, a controller 270 can be provided that contains electronic hardware with embedded software to communicate with user interface 280 via user interface cable 281, monitor signals from ram sensor 224 and terminal sensor 222, control motor 252, and exchange data with an external device through data interface 272. A power supply and power and ground connections is also provided (not shown). Controller 270 can include a microcomputer 274, such as a single chip computing device capable of executing software instructions. Hardware elements contained within microcomputer 274 can include, but are not limited to, input and output data ports, processor, clock/oscillator, power-up reset circuits, and volatile and non-volatile memory storage for the software program and data. Controller 270 provides the "intelligence" to process signals from user interface 280, external equipment, and sensors to control drive mechanism 250 to achieve proper terminal 12 progression.

Figure 12:
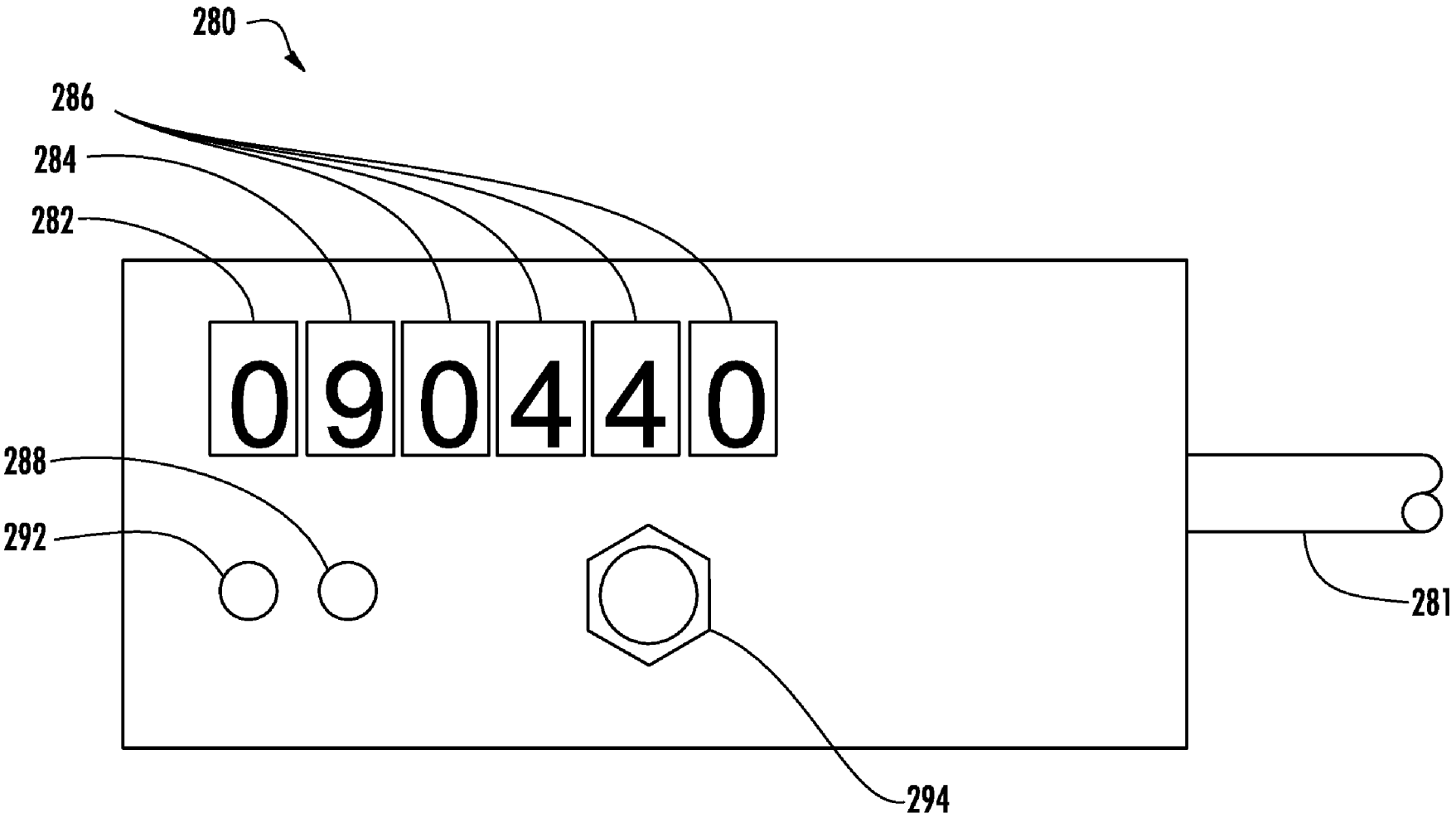
FIG. 12 is a plan view of a user interface of the applicator shown in FIG. 9 in accordance with one embodiment of the present invention.

Referring now to FIG. 12, the construction and functionality of a user interface 280 contemplated in one embodiment will now be described. User interface 280 can contain a delay thumbwheel switch 282, a speed thumbwheel switch 284, multiple progression thumbwheel switches 286, a "Power" LED 288, a "Ready" LED 292, and a manual switch 294. Each of the thumbwheel switches can assume ten (10) states and each state is represented by displaying one of numbers 0 through 9. Two buttons on each thumbwheel switch allow the selected number to be incremented or decremented. User interface 280 can communicate with microcomputer 274 within controller 270 via user interface cable 281. Manual switch 294 is a momentary contact switch.

Power LED 288 is typically on if electrical power is applied to applicator 200 and Power LED 288 is off otherwise. Ready LED 292 is on whenever applicator 200 is in a state which will allow initiation of a feed cycle for terminal 12, that is, advancing the next terminal 12 to be crimped to a proper position over anvil 208.

Speed thumbwheel switch 284 is used to select the speed at which terminals 12 are advanced, typically with selection "1" being the slowest and selection "9" being the fastest. Selecting "0" prevents feed cycles from being initiated. Ready LED 292 is typically off whenever speed thumbwheel switch 282 selection is "0." Assuming a non-zero speed selection is made on speed thumbwheel switch 284, a feed cycle is initiated when controller 270 senses the upward stroke of ram 204 as a result of monitoring ram sensor 224 or when manual switch 294 is depressed. Manual switch 294 facilitates setting up a production run by allowing an operator to initiate feed cycles without having to move ram 204.

Delay thumbwheel switch 282 enables an operator to introduce a delay between a stimulus to initiate a feed cycle (the stimulus being the upward motion of ram 204 or depression of manual switch 294) and the actual initiation of the feed cycle. A delay thumbwheel switch 282 selection of "0" typically provides no delay, a selection of "1" provides the shortest delay, and a selection of "9" provides the longest delay. Delays are provided to allow crimped terminal 12 and wire to be removed from the crimping zone of applicator 200 prior to initiation of the next feed cycle.

When a feed cycle stimulus is received by controller 270 and a non-zero speed selection has been made and any selected delay has expired, controller 270 typically implements a feed cycle as follows.

Pulses are delivered to motor 252 at a rate appropriate for the speed selection. Simultaneously, the output of terminal sensor 222 is monitored. Pulses are applied until the first occurrence of one of the following events: (A) terminal sensor 222 transitions from a state of light not being blocked to a state of light being blocked or other appropriate transition, or (B) a pre-determined number of pulses has been delivered to motor 252. If event A occurs first, terminal 12 progression continues by delivering a number of pulses to motor 252 equal to the number specified in the progression thumbwheel switches 286 (at a rate appropriate to the selected speed). After the final pulse is delivered, controller 270 returns to monitoring ram sensor 224 and manual switch 294 in anticipation of another feed cycle. If event B occurs first, delivery of pulses to motor 252 stops and controller 270 returns to monitoring ram sensor 224 and manual switch 294 in anticipation of another feed cycle. This condition occurs when terminals 12 are no longer available, that is, such as when the end of the reel of terminals has been reached. It is noted that the feed cycle as described above may require sensing a terminal 12 (or some attribute of terminal carrier strip 14) to complete the cycle. As a result, if a positioning error exists, it will occur on each feed cycle, but the error will not be cumulative.

In order to set-up applicator 200 for a given terminal 12 (different sized terminals, etc.), an operator must determine the correct number to load into progression thumbwheel switches 286. This number is referred to as the progression number. In one embodiment, the progression number is stamped or printed on a terminal-specific tooling element of applicator 200, such as insulation punch 214 or guide plate 218. Other options for determining the progression number include, but are not limited to, the following: (1) use a trial and error method to determine the correct number; (2) obtain the number from published information or information available from the Internet; (3) implement a modified user interface which allows an operator to specify a terminal 12 by part number, wherein a database installed in controller 270 contains the progression number for the specified terminal 12; or (4) use a fully automatic method requiring no data input from an operator (as described in more detail hereinbelow).

Figure 13:
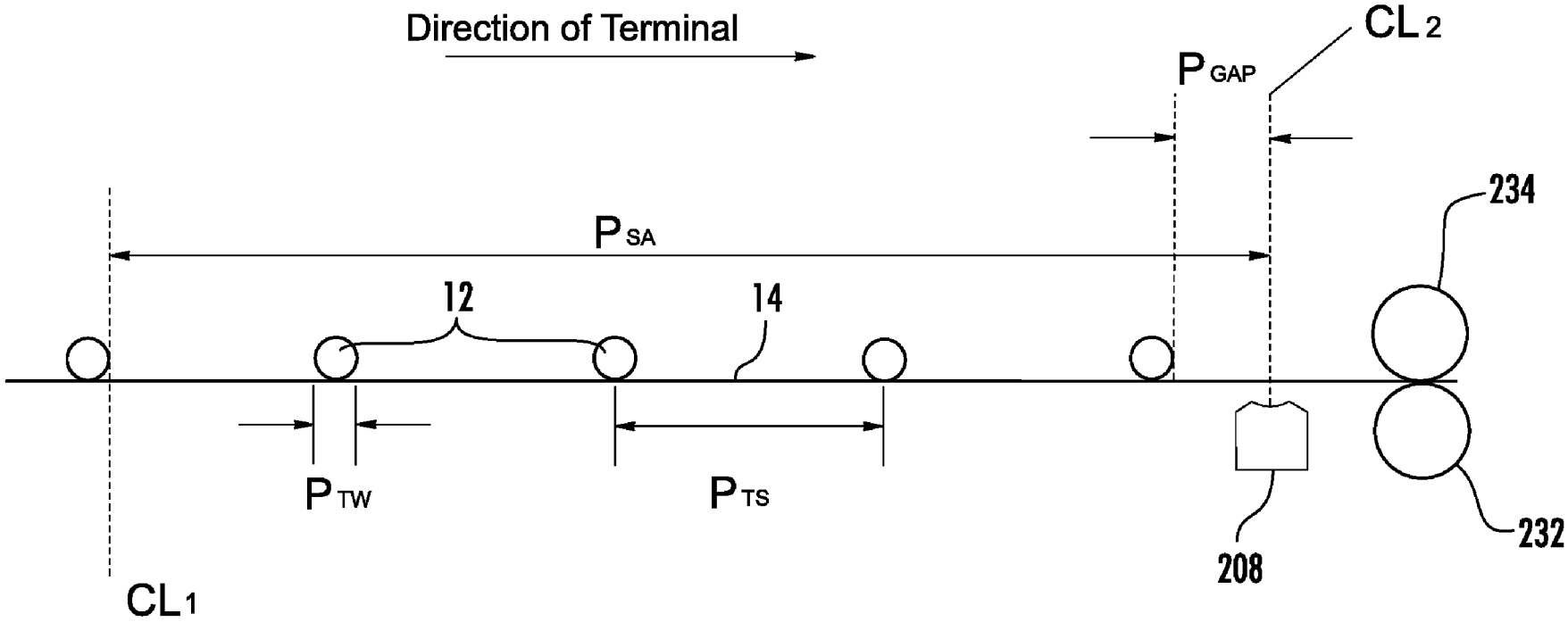
FIG. 13 is an elevation schematic view of the processing of a terminal in accordance with one embodiment of the present invention.

Referring now to FIG. 13, an elevation view of a terminal 12 on a terminal carrier strip 14 being fed past anvil 208 is presented. Since each pulse delivered to motor 252 results in a given angular displacement of motor 252 which results in a known, linear movement of terminal carrier strip 14, distances shown in FIG. 13 are represented by the number of pulses P delivered to motor 252. Using this nomenclature, the distances shown in FIG. 13 are as follows:

$P_{SA}$=Distance from center line $CL_1$ of terminal sensor 222 to center line $CL_2$ of anvil 208. This distance is known from design information for applicator 200;

$P_{TW}$=Width of terminal 12 (at that portion of terminal 12 where terminal sensor 222 is located);

$P_{TS}$=Distance between terminals 12 on terminal carrier strip 14 (center line to center line); and $P_{GAP}$=Distance between leading edge of the next terminal 12 to be crimped and center line $CL_2$ of anvil 208 when the leading edge of another terminal 12 is aligned with center line $CL_1$ of terminal sensor 222.

Automatic Progression Number Determination

After the operator has properly loaded terminals into applicator 200, a fully automatic method can be used to determine the progression number (in lieu of manual entry as described hereinabove). In such a method, it is assumed that terminal sensor 222 is positioned such that terminal 12 will block the light path between the light emitter and the light receiver in terminal sensor 22 as opposed to terminal carrier strip 14.

Figure 14:
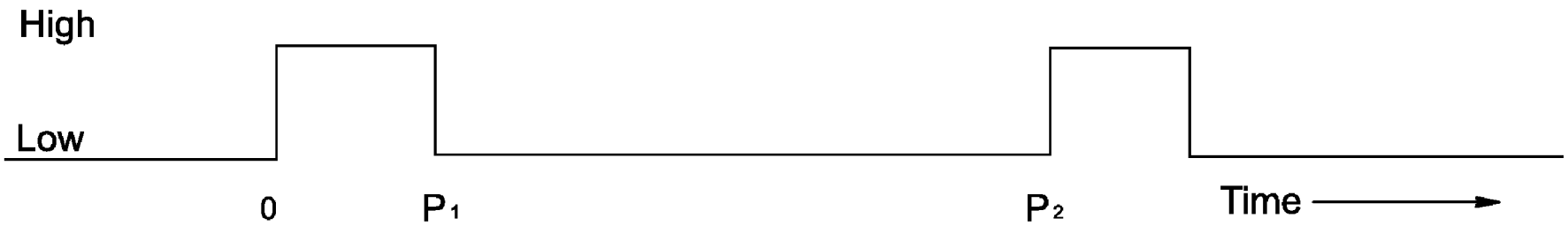
FIG. 14 is a graphical representation of a signal that is provided by a terminal sensor in accordance with one embodiment of the present invention.

Referring now to FIG. 14, a signal is illustrated that is provided by terminal sensor 222 as terminals 12 are advanced through terminal sensor 222. A "high" signal level represents the state where terminal 12 blocks the light between the light emitter and light receiver in terminal sensor 222. A "low" signal level represents the state where terminal 12 does not block the light between the light emitter and light receiver in terminal sensor 222.

To automatically determine the progression number, user interface 280 is modified to enable an operator to place applicator 200 in a "learning" mode. No further user input is required to determine the progression number. Referring further to FIG. 14, after applicator 200 has been placed into the learning mode, controller 270 advances terminals 12 until a low output from terminal sensor 222 is obtained, if necessary. Terminals 12 are then further advanced until a low to high transition from terminal sensor 222 occurs. If a low to high transition does not occur after a pre-determined number of pulses has been delivered to motor 252, then an end of reel condition has been sensed. For this case, no additional pulses are sent to motor 252 and the learning mode is terminated. If a low to high transition does occur before a pre-determined number of pulses are delivered to motor 252, this indicates that a terminal 12 has just blocked the light between the light emitter and light receiver of terminal sensor 222. The "count" of motor 252 (that is, the number of pulses delivered to motor 252) is designated as 0 at this point to establish a reference. Terminals 12 are then further advanced (and motor 252 counts are tallied) until a high to low transition from terminal sensor 222 occurs. This indicates that a terminal 12 has just stopped blocking the light between the light emitter and light receiver of terminal sensor 222. The motor 252 count at this point is stored in memory and is designated as $P_1$. Terminals 12 are then further advanced (and motor counts continue to be tallied from the original reference value of 0) until a low to high transition from terminal sensor 222 occurs. This indicates that the next terminal has just blocked the light between the light emitter and receiver of terminal sensor 222. The motor 252 count at this point is stored in memory and designated as $P_2$. Controller 270 then performs the following calculation to determine the progression number $P_{PROG}$:

$P_{SA}$=Known quantity(from design information of sensor 222 and anvil 208 positions)

$$P_{TW}=P_1$$

$$P_{TS}=P_2$$

$$P_{GAP}=[(P_{SA}/P_{TS})-INT(P_{SA}/P_{TS})](P_{TS})$$

$$P_{GAP}=[(P_{SA}/P_2)-INT(P_{SA}/P_2)](P_2)$$

$$P_{PROG}=P_{GAP}+0.5(P_{TW})$$

$$P_{PROG}=P_{GAP}+0.5(P_1)$$

where INT is the greatest integer function (the greatest integer function returns only the whole number portion of the quotient).

Half of the terminal width must be added to $P_{GAP}$ because $P_{GAP}$ is the distance from the forward-most edge of terminal 12, not the center line of terminal 12, to the center line of anvil 208 (see FIG. 13). After moving a distance of $P_{GAP}$, an additional distance equal to half of terminal 12 width must occur to center terminal 12 over anvil 208.

After completion of the learning mode, applicator 200 reverts to a normal mode during which controller 270 awaits initiation of a feed cycle by monitoring ram sensor 224 or manual switch 294.

Using a modified user interface 280, an operator can input an offset value to modify the progression number determined during the learn mode. For this case, the progression number is calculated as:

$$P_{PROG}=P_{GAP}+0.5(P_1)+\text{Offset}$$

Applicator Installation

To crimp wires to terminals 12, applicator 200 must be installed in a press, such as presses 50 or 130 described hereinabove. The press provides a means to physically secure applicator 200 and maintain it in a proper position. The press also provides the energy to cycle ram 204 first down toward anvil 208 and then away from anvil 208 to the original starting position to complete a crimping cycle. However, in all other respects, applicator 200, as described thus far, has no other reliance on the press. Applicator 200 has the requisite mechanical and control elements, including user interface 280, to allow proper set-up of and execution of production runs. This aspect supports use of applicator 200 in a wide variety of presses, including older presses which lack advanced features and capabilities of newer, modern presses.

In those cases where applicator 200 is used in a modern press having advanced features and capabilities (such as the KOMAX® MCI 711 press), or is used in a press which is installed in an automatic wire processing machine (such as the KOMAX® Gamma 333 PC), data interface 272 in controller 270 can be used to obtain additional functional benefits. In such cases, applicator 200 can support bi-directional data exchange with external equipment, be it the press, automatic wire processing equipment, or other equipment. With this arrangement, additional functional capabilities include, but are not limited to, the following: (1) the external equipment can download data to trigger a feed cycle; (2) the external equipment can determine and download data to specify the progression number, delay and speed settings, or to recommend settings which an operator may modify before downloading; (3) the user interface on the external equipment can enable an operator to manually specify the progression number, delay settings, and speed settings and download that data to the applicator 200; (4) the user interface on the external equipment can enable an operator to manually initiate a feed cycle without having to move ram 204; (5) applicator 200 can send data to the external equipment to convey operational status, including end of reel conditions; and (6) with an appropriately modified applicator 200, the external equipment can download data to control the release state of idler wheel 234 and the position of idler wheel 234 and drive wheel 232.

Method for Advancing Terminals

With reference to FIGS. 9-12, a method for advancing terminals will now be described. The method described herein typically relies on a pressure contact with terminal carrier strip 14. Terminal 12 feeding methods used by other applicators contain elements that exploit specific design characteristics of a specific terminal 12 or its terminal carrier strip 14. For example, prior art applicators typically include a feed paw designed to mate with a feed hole 16 of a certain size and spacing on terminal carrier strip 14. Therefore, as a practical matter, most prior art applicators work with only one terminal 12 or, at best, a few terminals 12 within a family of terminals 12. The feeding method as described herein is much more universal because the preferred pressure engagement with terminal carrier strip 14 is not dependent on any specific attribute of terminal carrier strip 14. This aspect provides very significant benefit, as described hereinbelow.

In accordance with an embodiment of the present invention, elements of applicator 200 which "touch" terminal 12, that is, are unique to the terminal 12 being crimped, is limited to guide plate 218, anvil 208, conductor punch 216, insulation punch 214 and, in some cases, cutter 212. Generally, the remaining elements of applicator 200 are not terminal specific. Referring to guide plate 218, anvil 208, conductor punch 216, insulation punch 214 and, in some cases, cutter 212 as a tool pack, a user of applicator 200 need purchase only one (or a few) applicators 200 even for a wide variety of terminal jobs. To handle specific terminals 12, the user need purchase only the tool pack for each specific terminal 12. As described hereinbelow, tool packs are installed in applicator 200 as required to accommodate different terminals. By avoiding the purchase of a complete applicator 200 for each terminal 12 to be crimped, the user enjoys substantial tooling savings.

As an example of the set up of applicator 200 for a production run, an operator can perform the following steps.

First, the appropriate tool pack (consisting of, for example, guide plate 218, anvil 208, conductor punch 216, insulation punch 214 and, in some cases, cutter 212) is installed into applicator 200 and applicator 200 is installed in a press. Next, the operator loads terminals 12 on terminal carrier strip 14 into guide plate 218, over anvil 208 and to idler wheel 234 and drive wheel 232. Idler wheel release 236 is set to a position that raises idler wheel 234 away from drive wheel 232. Terminal carrier strip 14 is placed between idler wheel 234 and drive wheel 232. If necessary, feed carriage adjustment screw 238 is adjusted to align idler wheel 234 and drive wheel 232 with terminal carrier strip 14. Idler wheel release 236 is set to a position that lowers idler wheel 234 against terminal carrier strip 14.

After this, crimp height adjustment dial 226 can be adjusted to the setting that provides the correct crimp height. The user can then load the correct progression number, such as that found printed on one of the tool pack elements, into user interface 280. The desired speed and delay can then be loaded into user interface 280 and manual switch 294 can be pressed once to position a terminal over the anvil. At this point, applicator 200 is set up and ready for operation.

Alternative Embodiments

Various alternative embodiments of the present invention are contemplated herein. In one embodiment discussed hereinabove, idler wheel 234 and drive wheel 232 are positioned to engage terminal carrier strip 14 post-termination or post-separation (that is, in a position downstream from anvil 208 of applicator 200). It is contemplated herein that idler wheel 234 and drive wheel 232 can be positioned to accept terminal carrier strip 14 pre-termination (that is, in a position upstream from anvil 208 of applicator 200). Likewise, in one embodiment discussed hereinabove, terminal sensor 222 is positioned in a location that is pre-termination. It is contemplated herein that terminal sensor 222 can be positioned in a location that is post-termination. In this latter alternative, terminal sensor 222 typically relies on attributes of terminal carrier strip 14.

In one embodiment discussed hereinabove, user interface 280 is typically tethered to motor and electronics enclosure 240 via user interface cable 281. It is contemplated herein that user interface 280 could be configured as follows: (1) integrated within motor and electronics enclosure 240; (2) remain separate from motor and electronics enclosure 240 using a wireless link, such as an infrared link or radio frequency (RF) link; or (3) omitted entirely by relying solely on a user interface in the press or automatic wire processing equipment.

In one embodiment discussed hereinabove, idler wheel 234 and drive wheel 232 are wheels (or rollers) as their names imply and thereby rely on rotary motion to advance terminal carrier strip 14. Alternatively, non-rotary methods can be employed to advance terminal carrier strip 14 and still utilize a pressure contact with terminal carrier strip 14. For example, a method is contemplated which includes two elements in which, at a first position, each moves toward terminal carrier strip 14 to capture or secure terminal carrier strip 14 by pressure. The two elements, while maintaining the hold on terminal carrier strip 14, then move together to a second position that moves terminal carrier strip 14 to properly position the next terminal 12 over anvil 208. The two elements then each move away from terminal carrier strip 14 to release the grip on terminal carrier strip 14. The two elements, while maintaining no grip on terminal carrier strip 14, return to the first position from which the feed cycle can be repeated. It is contemplated that these non-rotary feed cycles could be implemented pre-termination or post-termination.

In one embodiment discussed hereinabove, terminal sensor 222 is in a fixed position relative to anvil 208. It is contemplated that the distance of terminal sensor 222 relative to anvil 208 can be adjustable. To obtain proper positioning of terminal 12 over anvil 208 in this case, the operator would typically adjust the position of terminal sensor 222.

Finally, in one embodiment discussed hereinabove, all elements required to feed and crimp terminals 12 are included in applicator 200. It is further contemplated that those elements related to feeding terminal 12 (drive mechanism 250, including idler wheel 234 and drive wheel 232), feed carriage adjustment screw 238 and carriage, motor and electronics enclosure 240 (and all apparatuses contained therein), and user interface 280 are separated from applicator 200 and instead installed on the press. Since the press drives ram 204, it therefore knows the position of ram 204 without the need for ram sensor 224. Embodiments are possible with terminal sensor 222 remaining part of applicator 200 or being included with the press.

It will be understood that various details of the present invention may be changed without departing from the scope of the present invention. Furthermore, the foregoing description is for the purpose of illustration only, and not for the purpose of limitation, as the present invention is defined by the claims as set forth hereinafter.

What is claimed is:

1. A method for crimping electrical terminal connectors onto wires, the method comprising:

(a) providing a plurality of terminal connectors, the connectors being secured to a terminal strip in side-by-side relationship with their axes extending laterally from the strip;

(b) moving a crimping die on a ram through a working stroke towards, and a return stroke away from, a crimping anvil to crimp an individual terminal connector located therebetween onto a wire during each working stroke of the ram;

(c) indexing the strip between successive crimping operations thereby to locate a next leading connector on the strip between the die and anvil, wherein the strip is indexed by a drive mechanism contacting the strip through pressure-engagement;

(d) using a separating mechanism, separating the connector from the strip during connector crimping, the drive mechanism being positioned downstream of the separating mechanism.

2. The method according to claim 1 wherein the step of indexing the strip comprises applying pressure to the strip located between a drive mechanism comprising a drive roller and an idler roller biased against the drive roller.

3. The method according to claim 1 further comprising actuating the drive mechanism based on sensing by a terminal connector sensor.

4. The method according to claim 1 further comprising providing a crimp press and further wherein steps (a)-(c) occur within the crimp press.

5. The method according to claim 4 further comprising providing an automated wire processing machine and further wherein the crimp press is located in the wire processing machine.

* * * * *